US009247835B2

(12) United States Patent
Blethen et al.

(10) Patent No.: US 9,247,835 B2
(45) **Date of Patent: *Feb. 2, 2016**

(54) BEDDING APPARATUS

(71) Applicant: Zzz Sock, LLC, Mount Prospect, IL (US)

(72) Inventors: Jeffrey Ronald Blethen, Mount Prospect, IL (US); Kyle Parker Blatt, Mount Prospect, IL (US); Frederick David Winans, New York, NY (US)

(73) Assignee: Zzz Sock, LLC, Mount Prospect, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/491,600

(22) Filed: Sep. 19, 2014

(65) Prior Publication Data

US 2015/0007389 A1 Jan. 8, 2015

Related U.S. Application Data

(63) Continuation-in-part of application No. 14/289,238, filed on May 28, 2014.

(60) Provisional application No. 61/829,733, filed on May 31, 2013.

(51) Int. Cl.
*A47G 9/02* (2006.01)
*A47G 9/04* (2006.01)

(52) U.S. Cl.
CPC ..... *A47G 9/0238* (2013.01); *A47G 9/0246* (2013.01); *A47G 9/04* (2013.01); *A47G 9/02* (2013.01)

(58) Field of Classification Search
CPC ..... A47G 9/00–9/0238; A47D 15/008
See application file for complete search history.

(56) References Cited

U.S. PATENT DOCUMENTS

| | | | |
|---|---|---|---|
| 65,262 | A | 5/1867 | Ouroussaff |
| 2,324,665 | A | 7/1943 | Ayres |
| 2,368,220 | A | 1/1945 | Hinds |
| 2,972,757 | A | 2/1961 | Adrian |
| 3,120,721 | A | 2/1964 | Bukatman et al. |

(Continued)

OTHER PUBLICATIONS

Therm-a-Rest Ventra Down Comforter Sleeping Pad Accessory; available at www.backcountryedge.com; printed prior to May 31, 2013. (1 page).

(Continued)

*Primary Examiner* — Peter M Cuomo
*Assistant Examiner* — Brittany Wilson
(74) *Attorney, Agent, or Firm* — Neal, Gerber & Eisenberg LLP

(57) ABSTRACT

Various embodiments of the present disclosure provide a bedding apparatus. In one embodiment, the bedding apparatus is configured to slip over a mattress such that the bedding apparatus substantially encloses the mattress except the front or head of the mattress. The bedding apparatus is configured such that, once installed over the mattress, there is sufficient space between the top of the mattress and the top panel of the bedding apparatus to enable a user to lay atop the mattress and under the top panel of the bedding apparatus. Additionally, once installed, the bottom panel of the bedding apparatus is positioned under the mattress such that the bedding apparatus is held in place by a combination of the weight of the mattress and the weight of the user (when the user is laying on the mattress).

19 Claims, 29 Drawing Sheets

(56) References Cited

U.S. PATENT DOCUMENTS

| | | | |
|---|---|---|---|
| 3,241,161 | A | 3/1966 | Dashosh et al. |
| 4,236,263 | A | 12/1980 | Allee |
| 4,241,466 | A | 12/1980 | Mendyk |
| 4,292,700 | A | 10/1981 | Markel |
| 4,304,018 | A | 12/1981 | McClam |
| 4,413,368 | A | 11/1983 | Schuetze |
| 4,459,714 | A | 7/1984 | Lin |
| 4,513,461 | A | 4/1985 | Tardivel |
| 4,601,076 | A | 7/1986 | Knobeloch |
| 4,709,307 | A | 11/1987 | Branom |
| 4,758,868 | A | 7/1988 | Frijlink |
| 4,759,090 | A | 7/1988 | Sachetti |
| 4,774,734 | A | 10/1988 | Mills |
| 4,839,777 | A | 6/1989 | Janko et al. |
| 4,841,587 | A | 6/1989 | Carter et al. |
| 4,875,245 | A | 10/1989 | Isola |
| 4,878,258 | A | 11/1989 | Casey |
| 4,972,533 | A | 11/1990 | Brown |
| 5,003,655 | A | 4/1991 | Kafai |
| 5,066,001 | A | 11/1991 | Wilkinson |
| 5,208,927 | A | 5/1993 | Lachmar |
| 5,244,278 | A | 9/1993 | Robitaille |
| 5,465,440 | A | 11/1995 | Heptner |
| 5,566,411 | A | 10/1996 | Eiler |
| 5,740,566 | A | 4/1998 | Stacy |
| 6,098,219 | A | 8/2000 | Milber |
| 6,243,895 | B1 | 6/2001 | Amin |
| 6,490,741 | B1 | 12/2002 | Wheeler |
| 6,651,278 | B2 | 11/2003 | Ghanem |
| 6,886,197 | B1 | 5/2005 | Madigan |
| 7,051,387 | B1 | 5/2006 | Yoder et al. |
| D593,788 | S | 6/2009 | Thompson |
| 7,806,080 | B2 | 10/2010 | Morse |
| 7,818,833 | B2 | 10/2010 | Ewing |
| 7,845,031 | B2 | 12/2010 | Tatsuno |
| 8,214,949 | B2 | 7/2012 | Thompson |
| 8,640,282 | B2 | 2/2014 | Maguire et al. |
| 8,756,730 | B2 | 6/2014 | MacDonald |
| 2003/0177579 | A1 | 9/2003 | Diak/Ghanem |
| 2006/0053553 | A1 | 3/2006 | Gomeh |
| 2006/0248646 | A1 | 11/2006 | Marsh |
| 2008/0216238 | A1 | 9/2008 | Tatsuno |
| 2009/0044337 | A1 | 2/2009 | McKee |
| 2009/0293195 | A1 | 12/2009 | McGrath et al. |
| 2010/0251482 | A1 | 10/2010 | MacDonald |
| 2012/0204348 | A1 | 8/2012 | Bayer |

OTHER PUBLICATIONS

Disney Princesses EZ Bed; available at http://www.walmart.com/ip/Disney-Princesses-EZ-Bed/8812037; printed prior to May 31, 2013. (1 page).

Disney Cars EZ Bed; available at http://www.walmart.com/ip/Disney-Cars-EZ-Bed/8812034; printed prior to May 31, 2013 . (1 page).

Sleeping Bag Sofa; available at http://www.dudeiwantthat.com/household/furniture/sleeping-bag-sofa.asp; printed prior to May 31, 2013. (2 pages).

Zipit Bedding, website, zipitbedding.com/Home.html, screenshot as of Apr. 26, 2013 (2 pages).

BEDDING APPARATUS

PRIORITY CLAIM

This application is a continuation-in-part of, and claims priority to and the benefit of, U.S. patent application Ser. No. 14/289,238, filed on May 28, 2014, which claims priority to and the benefit of U.S. Provisional Patent Application No. 61/829,733, filed on May 31, 2013, the entire contents of each of which are incorporated herein by reference.

BACKGROUND

Known bedding typically includes a fitted sheet that snugly fits over a mattress; a flat sheet positioned over the fitted sheet; and a blanket, comforter, or duvet positioned over the flat sheet. Since the flat sheet and the blanket are not securely attached to the mattress, the flat sheet and the blanket may (and commonly do) substantially shift and/or fall off of the mattress during use (such as when a user is sleeping). This can cause certain users discomfort, such as causing the users to become cold in the middle of the night and disrupting the user's sleep. Additionally, this makes it more difficult and time consuming for the user to make the bed, as the user must first gather and re-position the flat sheet and the blanket before making the bed.

There is, therefore, a continuing need for bedding apparatuses that do not shift or fall off of the mattress during use and that facilitate quickly and easily making the bed after use.

SUMMARY

Various embodiments of the present disclosure provide a bedding apparatus. In one embodiment, the bedding apparatus is configured to slip over a mattress such that the bedding apparatus substantially encloses the mattress except the front or head of the mattress. The bedding apparatus is configured such that, once installed over the mattress, there is sufficient space between the top of the mattress and a top panel of the bedding apparatus to enable a user to lay atop the mattress and under the top panel of the bedding apparatus. Additionally, once the bedding apparatus is installed, a bottom panel of the bedding apparatus is positioned under the mattress such that the bedding apparatus is held in place by a combination of the weight of the mattress and the weight of the user (when the user is laying on the mattress). Thus, when the mattress is in use, such as when the user is sleeping, the combination of the weight of the user and the weight of the mattress secures the bedding apparatus in place such that the bedding apparatus does not substantially shift. In this embodiment, the bedding apparatus includes one or more attachment mechanisms (such as one or more zippers) along either side panel that enable the user to quickly and easily make the bed after use.

In certain embodiments, the bedding apparatus includes an upper portion and a lower portion that are completely separated from one another and are joinable to one another (and unjoinable from one another) via one or more attachment mechanisms (such as one or more zippers).

Additional features and advantages are described herein, and will be apparent from the following Detailed Description and the Figures.

DETAILED DESCRIPTION

Various embodiments of the present disclosure provide a bedding apparatus. In one embodiment, the bedding apparatus is configured to slip over a mattress such that the bedding apparatus substantially encloses the mattress except the front or head of the mattress. The bedding apparatus is configured such that, once installed over the mattress, there is sufficient space between the top of the mattress and the top panel of the bedding apparatus to enable a user to lay atop the mattress and under a top panel of the bedding apparatus. Additionally, once the bedding apparatus is installed, a bottom panel of the bedding apparatus is positioned under the mattress such that the bedding apparatus is held in place by a combination of the weight of the mattress and the weight of the user (when the user is laying on the mattress). Thus, when the mattress is in use, such as when the user is sleeping, the combination of the weight of the user and the weight of the mattress secures the bedding apparatus in place such that the bedding apparatus does not substantially shift. In this embodiment, the bedding apparatus includes attachment mechanisms (such as zippers) along either side panel that enable the user to quickly and easily make the bed after use.

Figure 1:
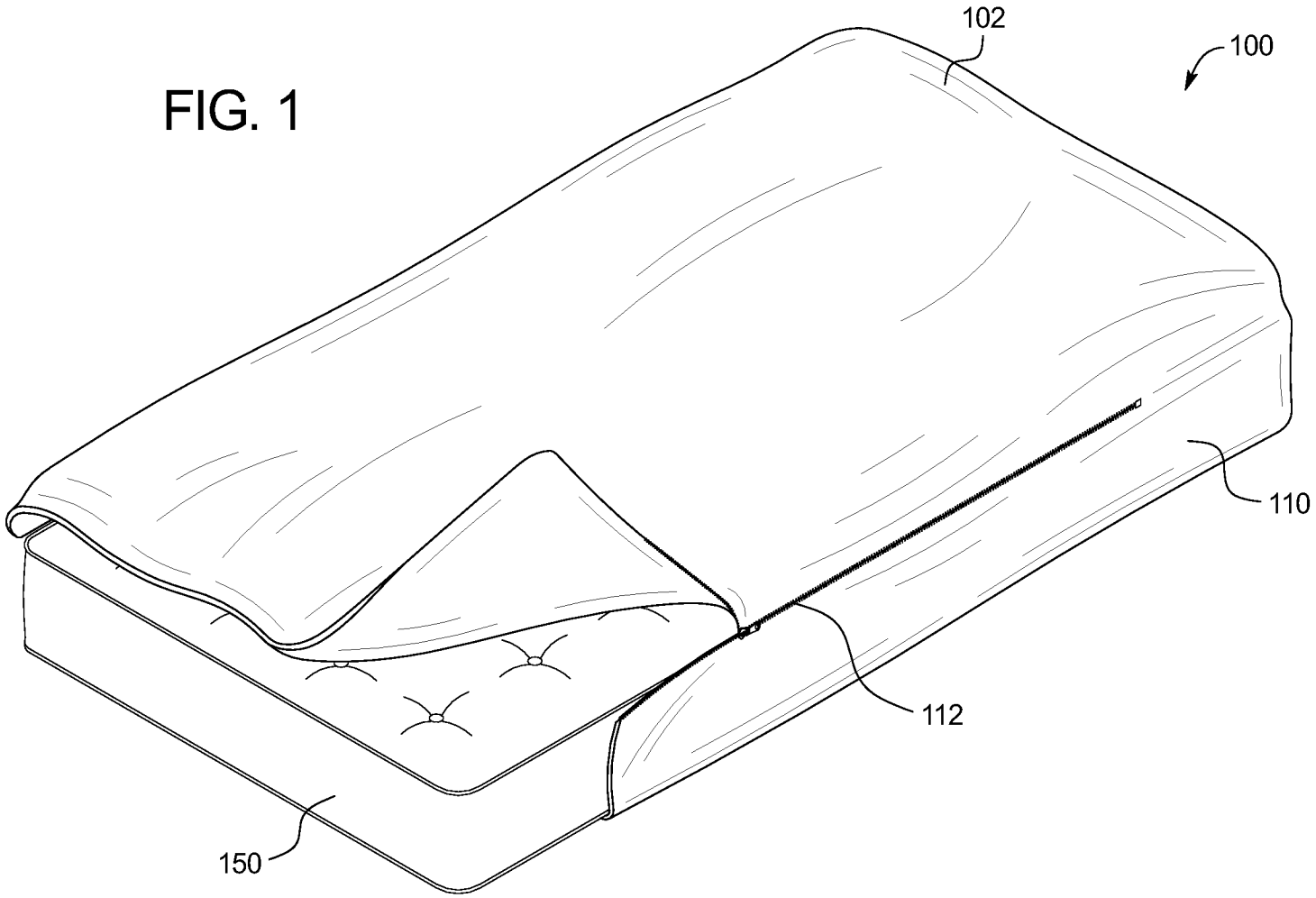
FIG. 1 is a top front right side perspective view of one example embodiment of the bedding apparatus of the present disclosure in a partially-assembled resting state and installed around a mattress.

Turning to the Figures, FIGS. 1 to 11 show one embodiment of the bedding apparatus, which is generally indicated by numeral 100. FIG. 1 shows the bedding apparatus 100 in a resting state. FIGS. 2 to 11 show the bedding apparatus 100 in an expanded state for illustrative purposes. In this embodiment, the bedding apparatus 100 includes: (a) a generally rectangular top panel 102 having a length L1 and a width W1; (b) a spaced apart opposing generally rectangular bottom panel 114 having a length L2 (which is less than the length L1) and the width W1; (c) a left side panel 106 including a generally rectangular upper portion having the length L1 and a height H1 and a generally rectangular lower portion having the length L2 and the height H1, the upper and lower portions being partially separated and partially joined or connected; (d) a spaced apart opposing right side panel 110 including a generally rectangular upper portion having the length L1 and the height H1 and a generally rectangular lower portion having the length L2 and the height H1, the upper and lower portions being partially separated and partially joined or connected; (e) a generally rectangular back panel 108 having a height H2 (which is approximately twice the height H1) and the width W1; (f) a left attachment mechanism 104, which is a zipper in this embodiment, configured to join (and unjoin) the partially separated upper and lower portions of the left side panel 106; and (g) a right attachment mechanism 112, which is a zipper in this embodiment, configured to join (and unjoin) the partially separated upper and lower portions of the right side panel 110.

In this embodiment: (a) a right edge of the top panel 102 is joined or connected to a top edge of the upper portion of the right side panel 110, (b) a back edge of the top panel 102 is joined or connected to a top edge of the back panel 108, (c) a left edge of the top panel 102 is joined or connected to a top edge of the upper portion of the left side panel 106, (d) a right edge of the bottom panel 114 is joined or connected to a bottom edge of the lower portion of the right side panel 110, (e) a back edge of the bottom panel 114 is joined or connected to a bottom edge of the back panel 108, (f) a left edge of the bottom panel 114 is joined or connected to a bottom edge of the lower portion of the left side panel 106, (g) a right edge of the back panel 108 is joined or connected to a back edge of the right side panel 110, and (h) a left edge of the back panel 108 is joined or connected to a back edge of the left side panel 106. In this embodiment, inner surfaces of the top panel 102, the back panel 108, the left side panel 106, the right side panel 110, and the bottom panel 114 define a mattress receiving space.

In operation of this embodiment, the bedding apparatus 100 is installed around a mattress 150, such as a traditional mattress, an air mattress, or any other suitable type of mattress. More specifically, to install the bedding apparatus 100 around the mattress 150, a user slides the mattress 150 into the mattress receiving space of the bedding apparatus 100 such that: (i) a bottom face of the mattress lays atop the inner surface of the bottom panel 114 of the bedding apparatus 100, (ii) a back face of the mattress is positioned proximate the inner surface of the back panel 108 of the bedding apparatus 100, (iii) a right face of the mattress is positioned proximate the inner surface of the right side panel 110 of the bedding apparatus 100, and (iv) a left face of the mattress is positioned proximate the inner surface of the left side panel 106 of the bedding apparatus 100. Put differently, the user slides the bottom panel 114 of the bedding apparatus 100 under the mattress 150 such that the bedding apparatus 100 substantially encloses the mattress 150 except for the front or head of the mattress 150. It should be appreciated that one or more of the right and left zippers 104 and 112 may be unzipped to facilitate sliding the bottom panel 114 of the bedding apparatus under the mattress 150.

Figure 2:
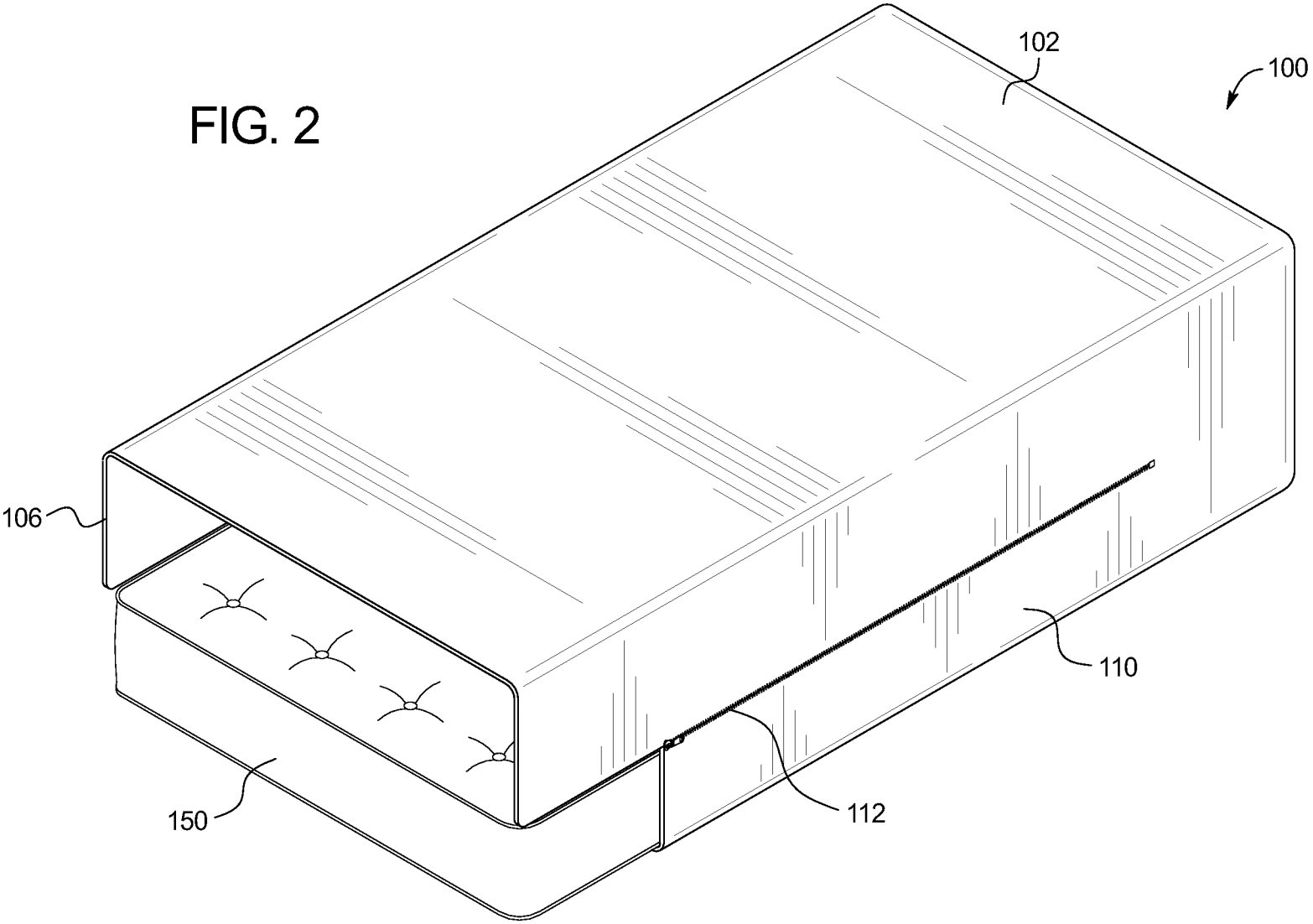
FIG. 2 is a top front right side perspective view of the bedding apparatus of FIG. 1 in an assembled expanded state and installed around a mattress.
Figure 3:
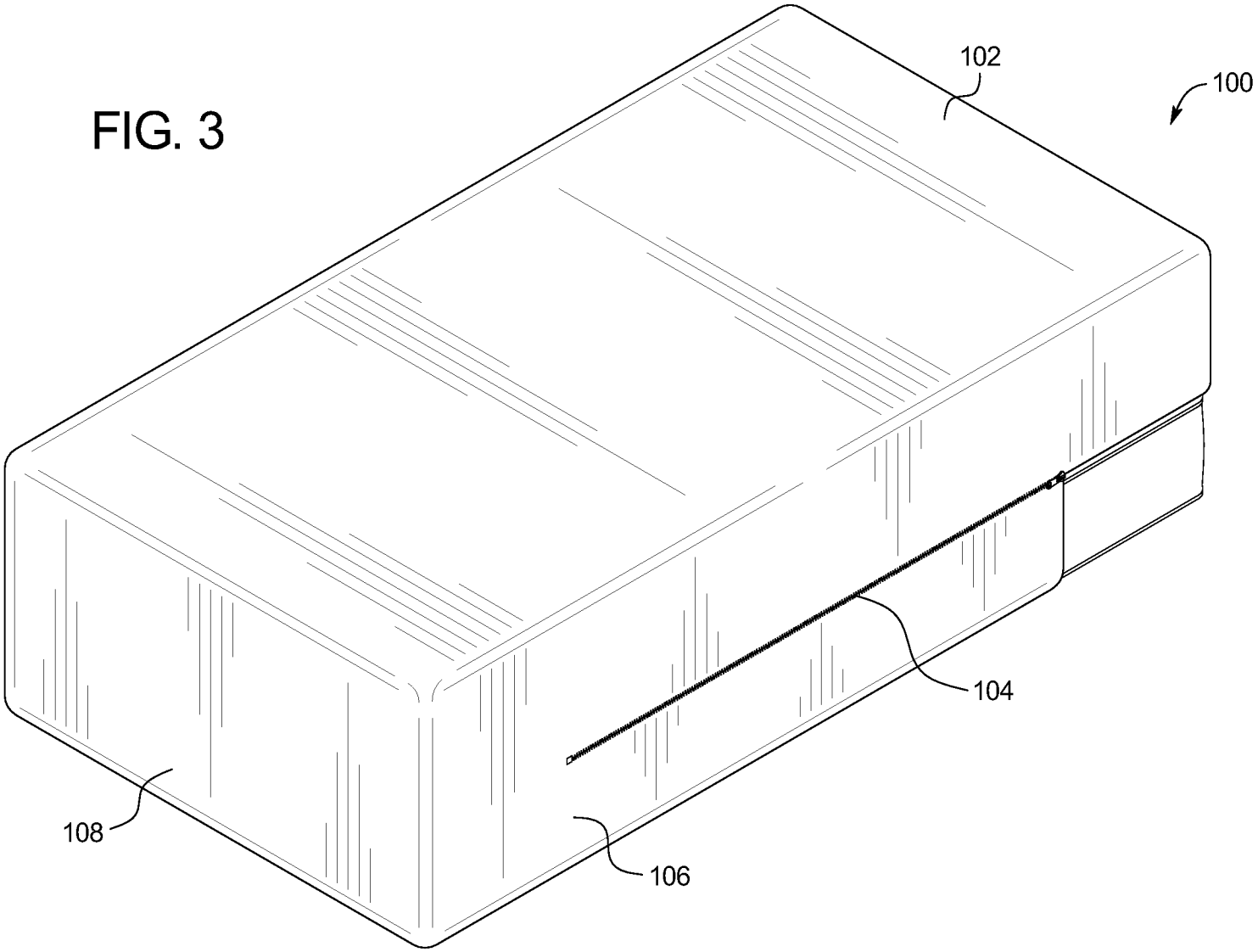
FIG. 3 is a top rear left side perspective view of the bedding apparatus of FIG. 1 in the assembled expanded state and installed around a mattress.
Figure 4:
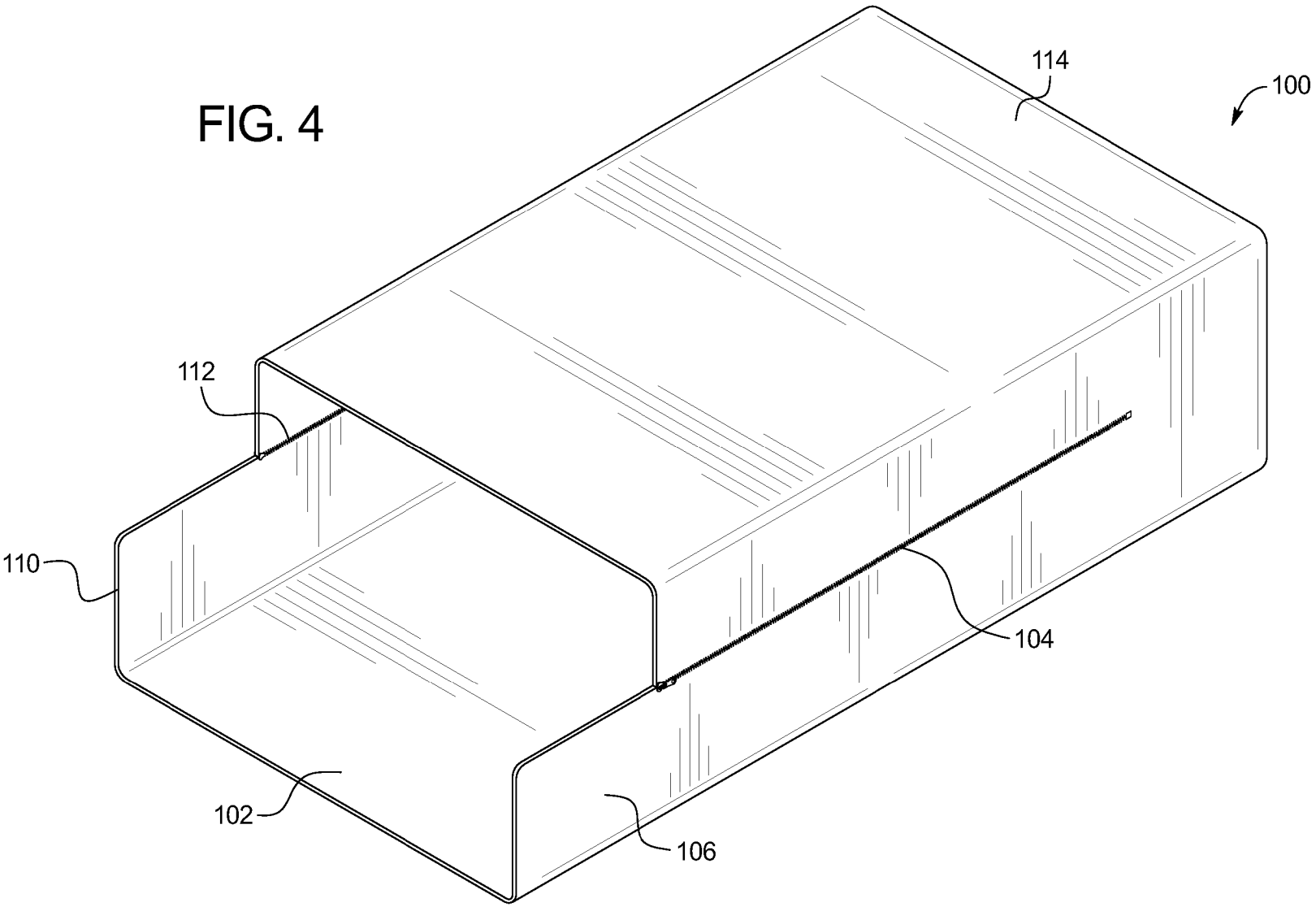
FIG. 4 is a bottom front left side perspective view of the bedding apparatus of FIG. 1 in the assembled expanded state.
Figure 5:
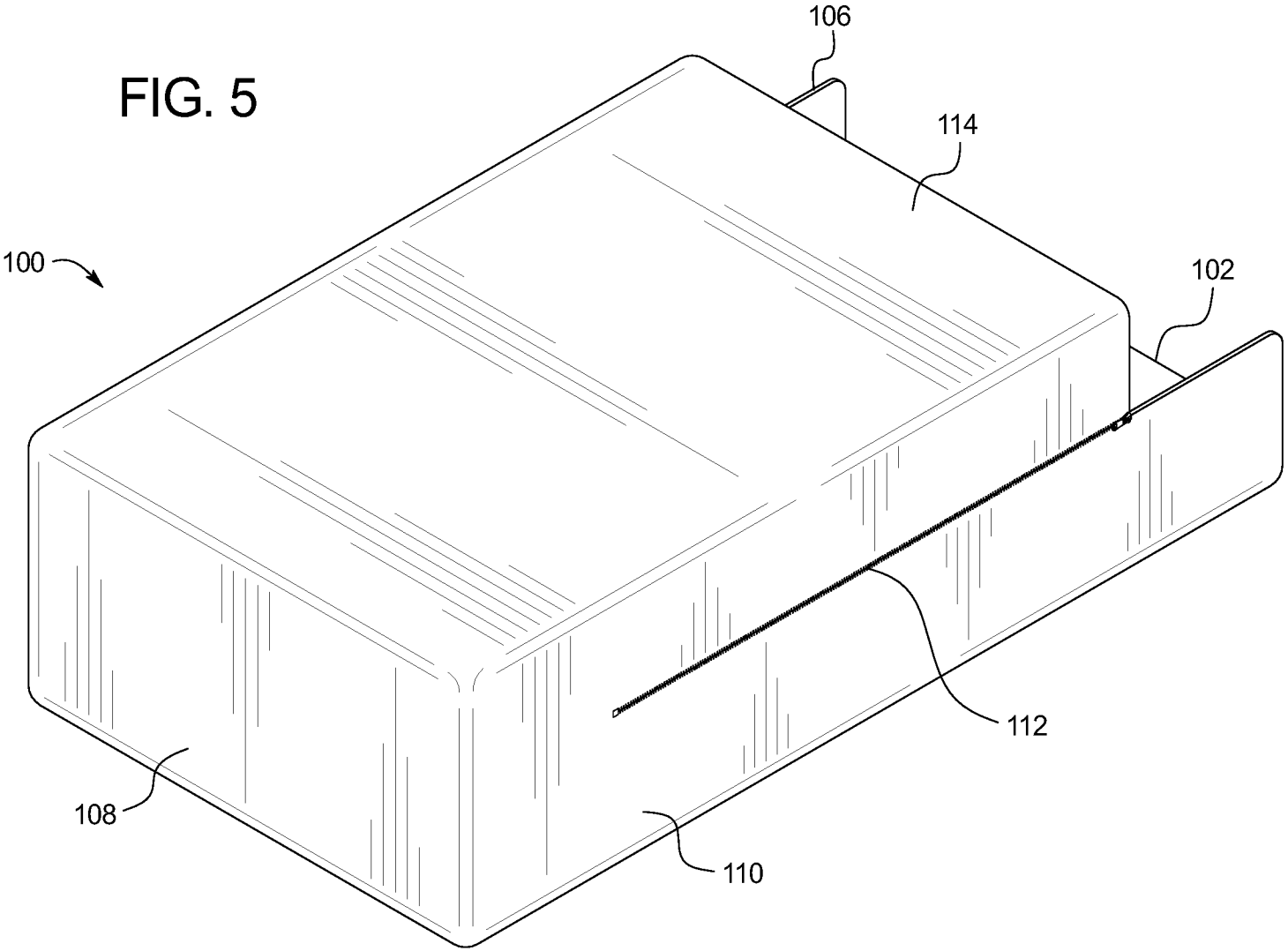
FIG. 5 is a bottom rear right side perspective view of the bedding apparatus of FIG. 1 in the assembled expanded state.
Figure 6:
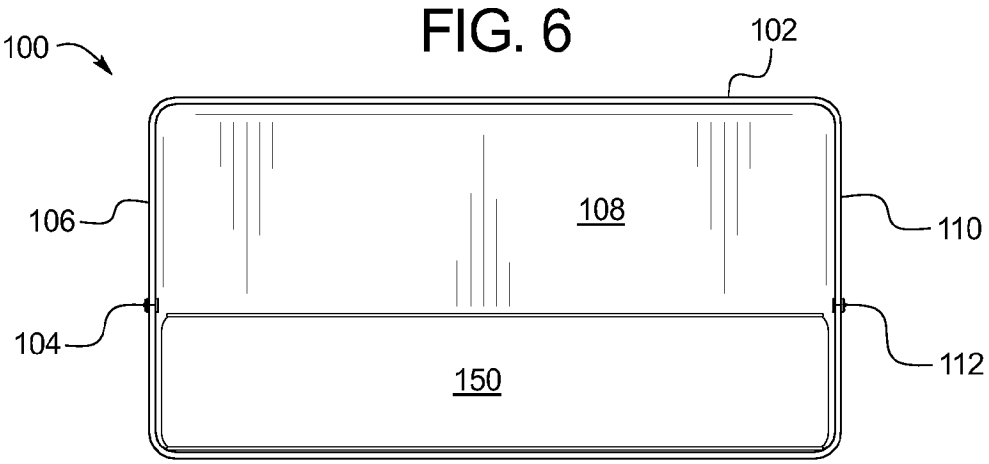
FIG. 6 is a front elevational view of the bedding apparatus of FIG. 1 in the assembled expanded state and installed around a mattress.
Figure 7:
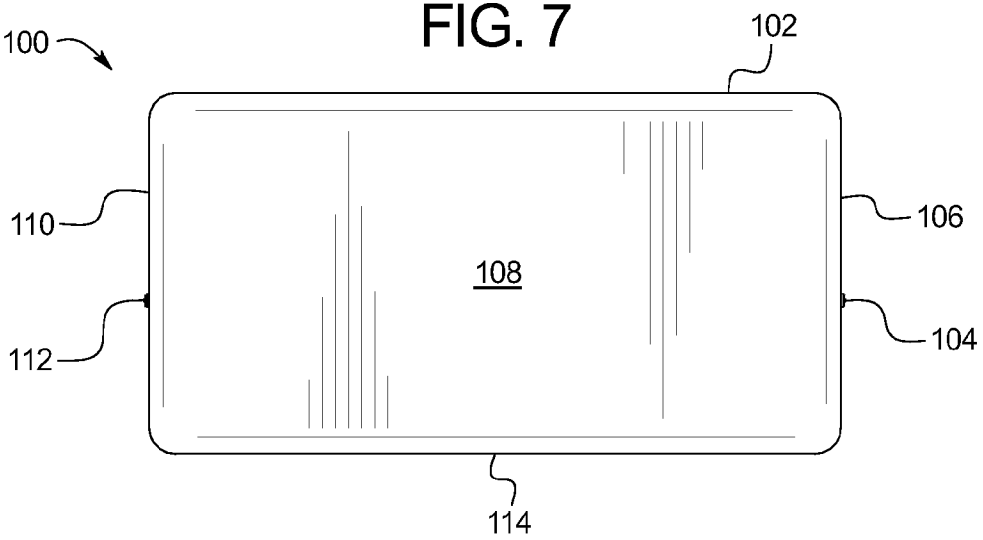
FIG. 7 is a rear elevational view of the bedding apparatus of FIG. 1 in the assembled expanded state.
Figure 8:
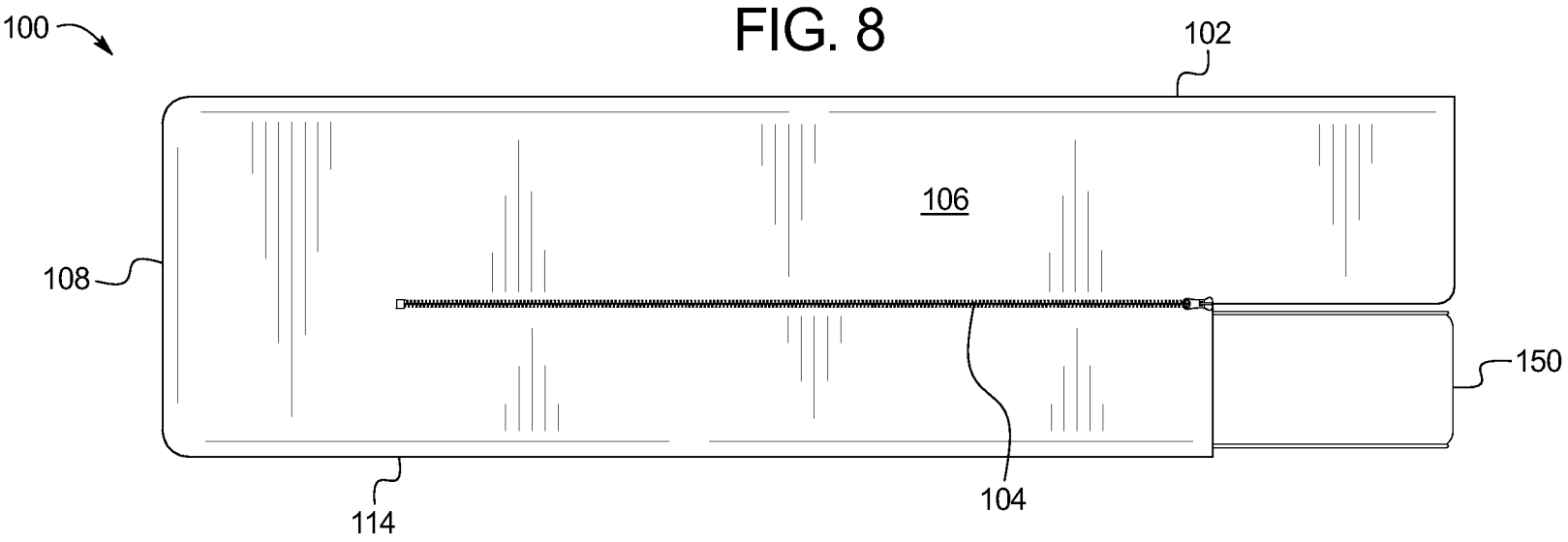
FIG. 8 is a left side elevational view of the bedding apparatus of FIG. 1 in the assembled expanded state and installed around a mattress.
Figure 9:
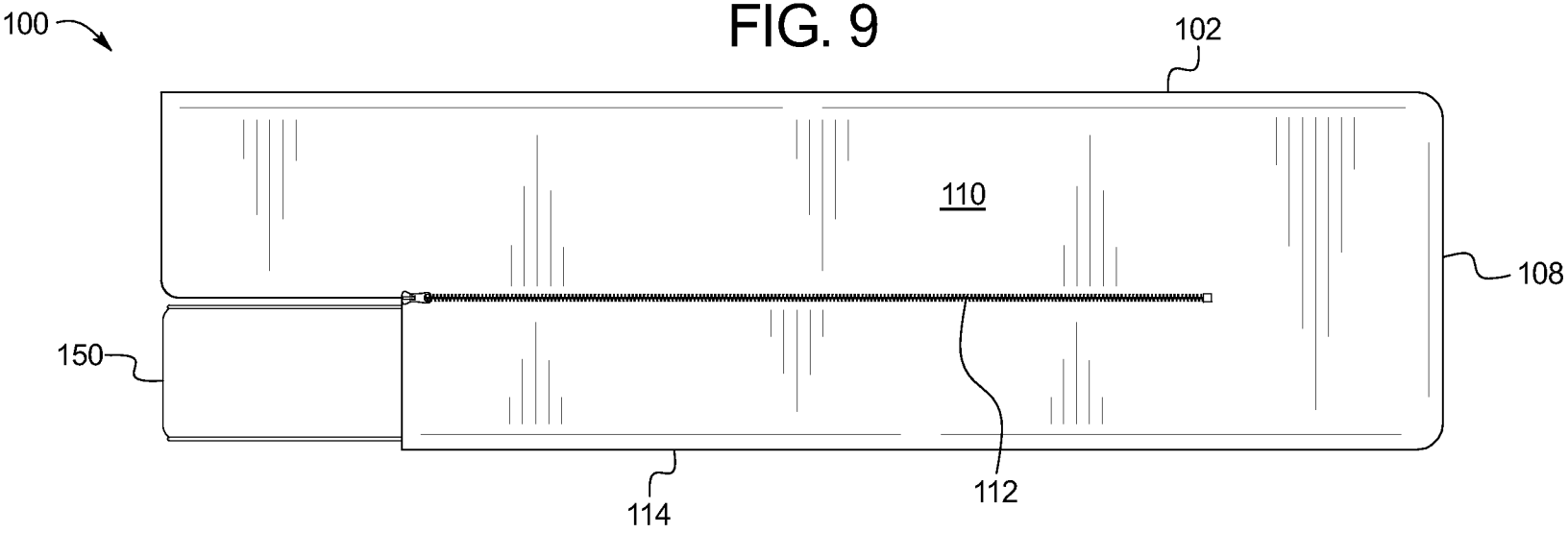
FIG. 9 is a right side elevational view of the bedding apparatus of FIG. 1 in the assembled expanded state and installed around a mattress.
Figure 10:
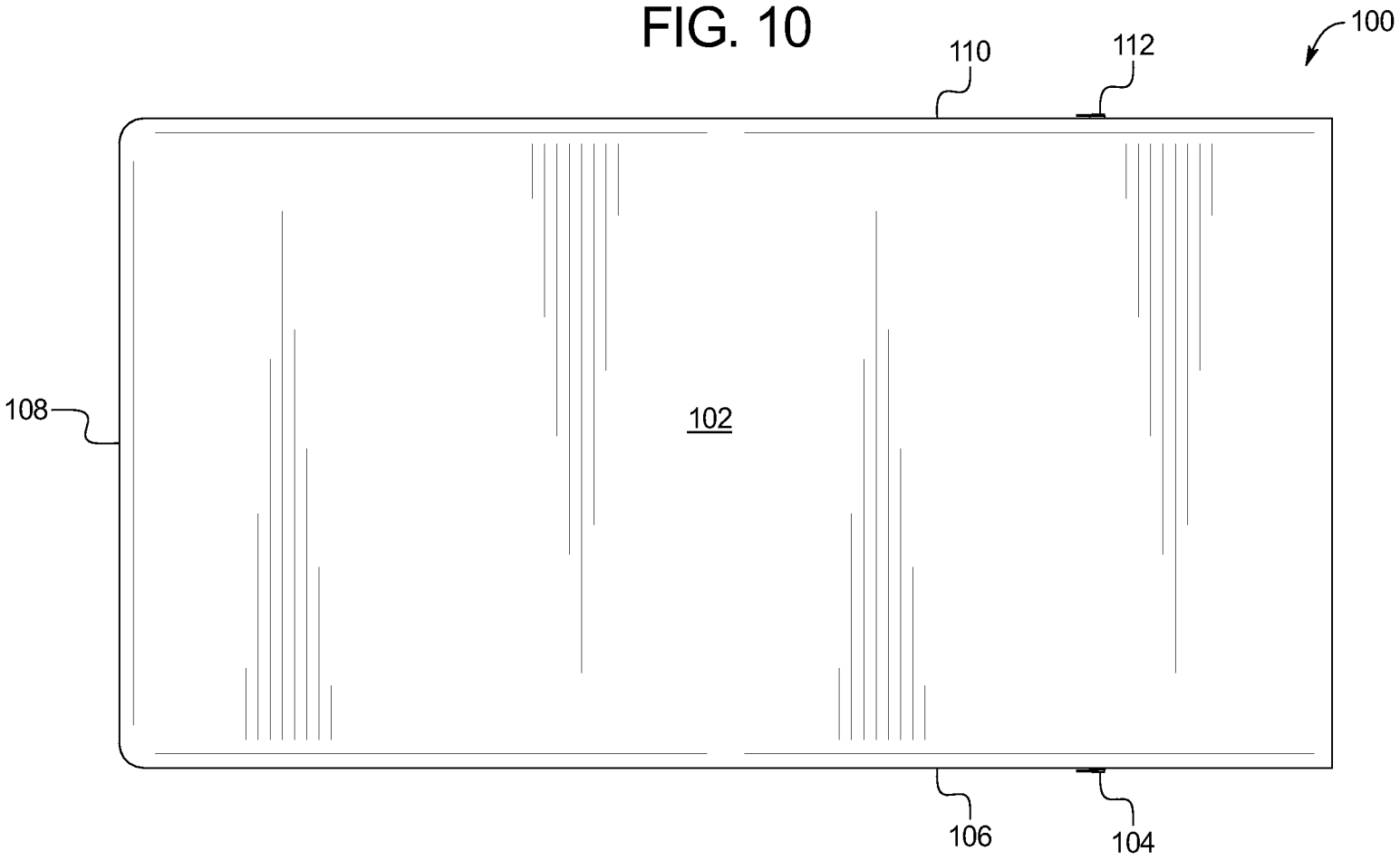
FIG. 10 is a top plan view of the bedding apparatus of FIG. 1 in the assembled expanded state.
Figure 11:
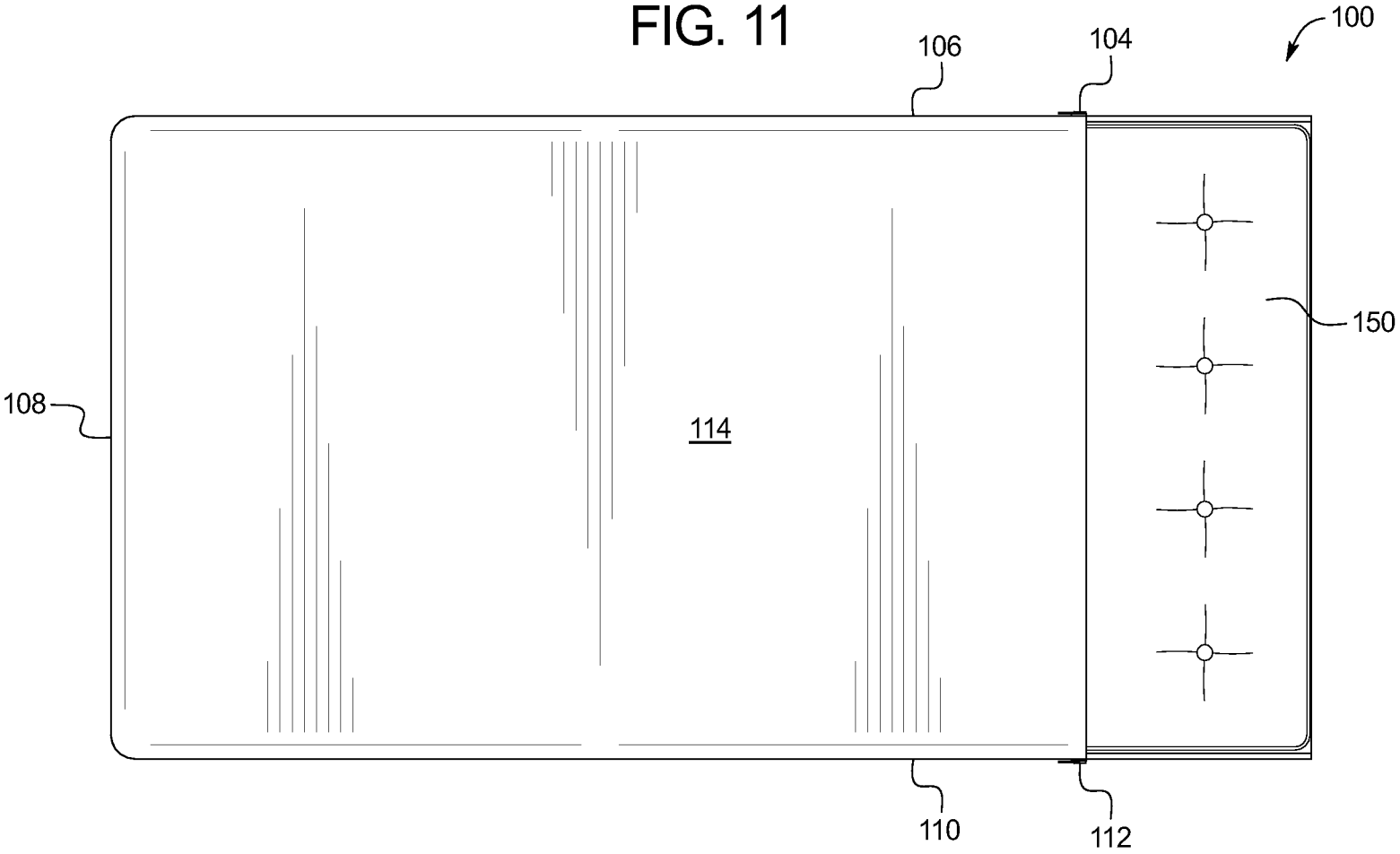
FIG. 11 is a bottom plan view of the bedding apparatus of FIG. 1 in the assembled expanded state and installed around a mattress.

As best shown in FIG. 2, after installation, the mattress occupies substantially the lower half of the mattress receiving space, leaving the upper half of the mattress receiving space vacant. This vacant space enables the user to lay atop the mattress and under the top panel of the bedding apparatus. In this embodiment, the bedding apparatus is held in place by a combination of the weight of the mattress and the weight of a user when the user is laying on the mattress. Thus, when the mattress is in use, such as when the user is sleeping, the combination of the weight of the user and the weight of the mattress secures the bedding apparatus in place such that the bedding apparatus does not substantially shift.

The user may unzip one or more of the zippers to facilitate getting under the top panel of the bedding apparatus and/or getting out from under the top panel of the bedding apparatus. The user may also unzip one or more of the zippers to facilitate changing bed sheets, such as a fitted sheet. The user may also zip up the zippers after use to quickly and easily make the bed.

It should be appreciated that the bottom panel of the bedding apparatus may be held in place between the mattress and a box spring, the mattress and a bunkie board, the mattress and a floor, or the mattress and any other suitable structure or object.

It should be appreciated that the bedding apparatus of the present disclosure may be sized to fit one of a variety of different mattress sizes, such as, but not limited to: (a) a twin size mattress, (b) an extra-long twin size mattress, (c) a full size mattress, (d) an extra-long full size mattress, (e) a queen size mattress, (f) a California king size mattress, and (g) a king size mattress.

In another embodiment, the bedding apparatus includes a single attachment mechanism rather than two attachment mechanisms. In one example of this embodiment, one of the left and the right side panels does not include an attachment mechanism, and the entire upper and lower portions of that side panel are joined or connected.

In another embodiment, the bedding apparatus includes a third attachment mechanism. In one example of this embodiment, the back panel of the bedding apparatus includes partially (or completely) separated upper and lower portions, and the third attachment mechanism is configured to join (and unjoin) the partially separated upper and lower portions of the back panel of the bedding apparatus.

In certain embodiments, the bedding apparatus includes an upper portion and a lower portion that are completely separated from one another and are joinable to one another (and unjoinable from one another) via one or more attachment mechanisms (such as one or more zippers).

Figure 12:
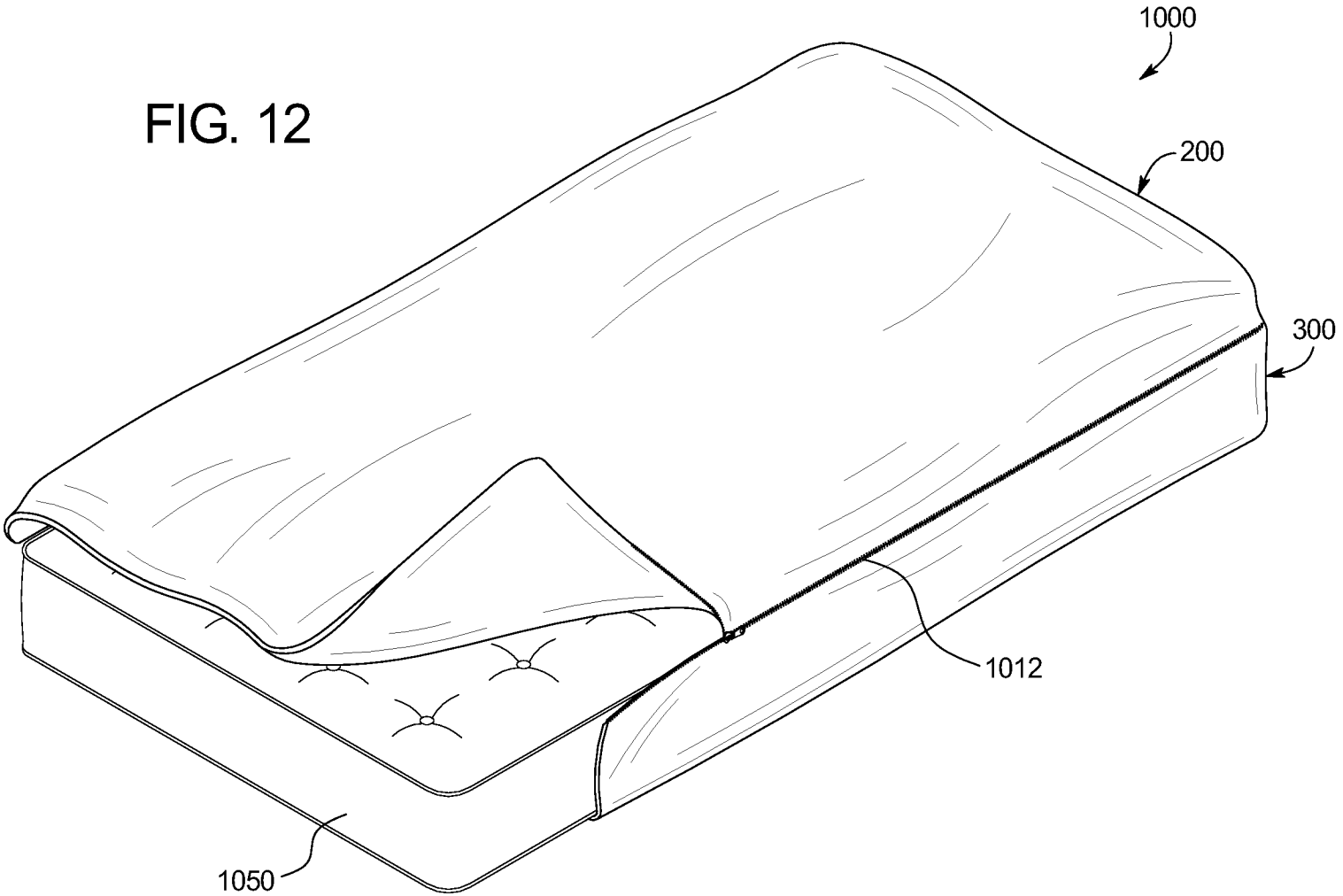
FIG. 12 is a top front right side perspective view of another example embodiment of the bedding apparatus of the present disclosure in a partially-assembled resting state and installed around a mattress.
Figure 13:
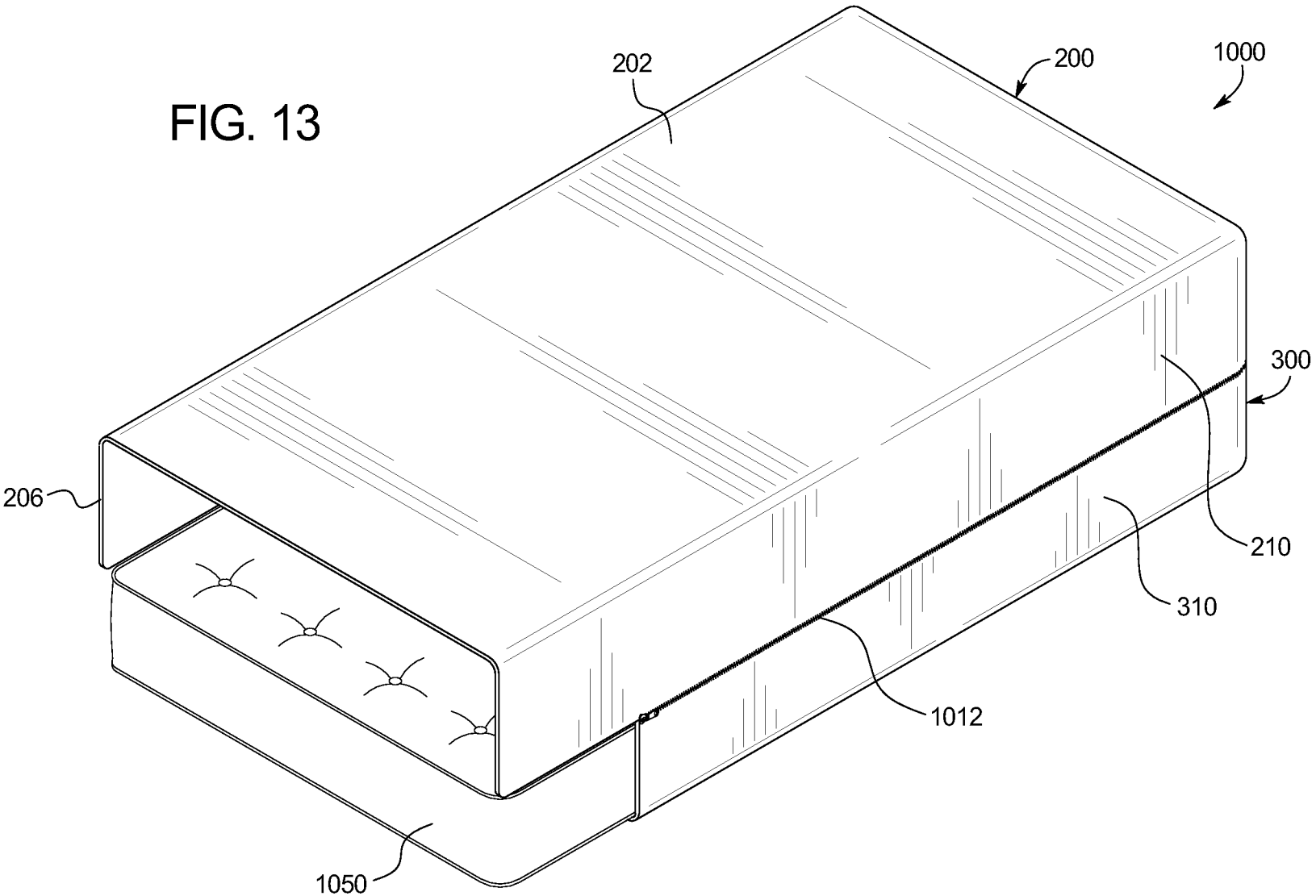
FIG. 13 is a top front right side perspective view of the bedding apparatus of FIG. 12 in an assembled expanded state and installed around a mattress.
Figure 14:
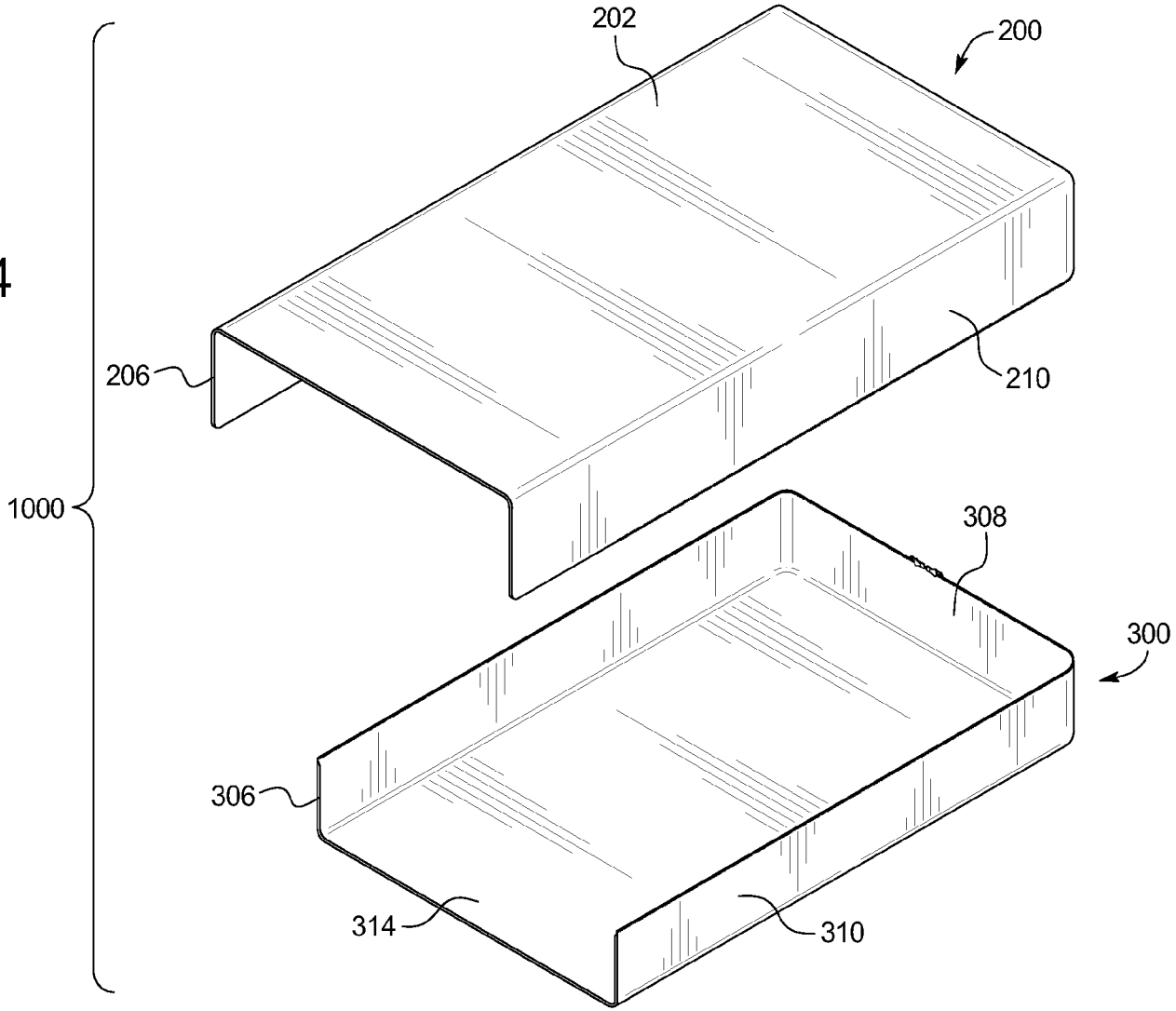
FIG. 14 is a top front right side perspective view of the bedding apparatus of FIG. 12 in an exploded expanded state.
Figure 15:
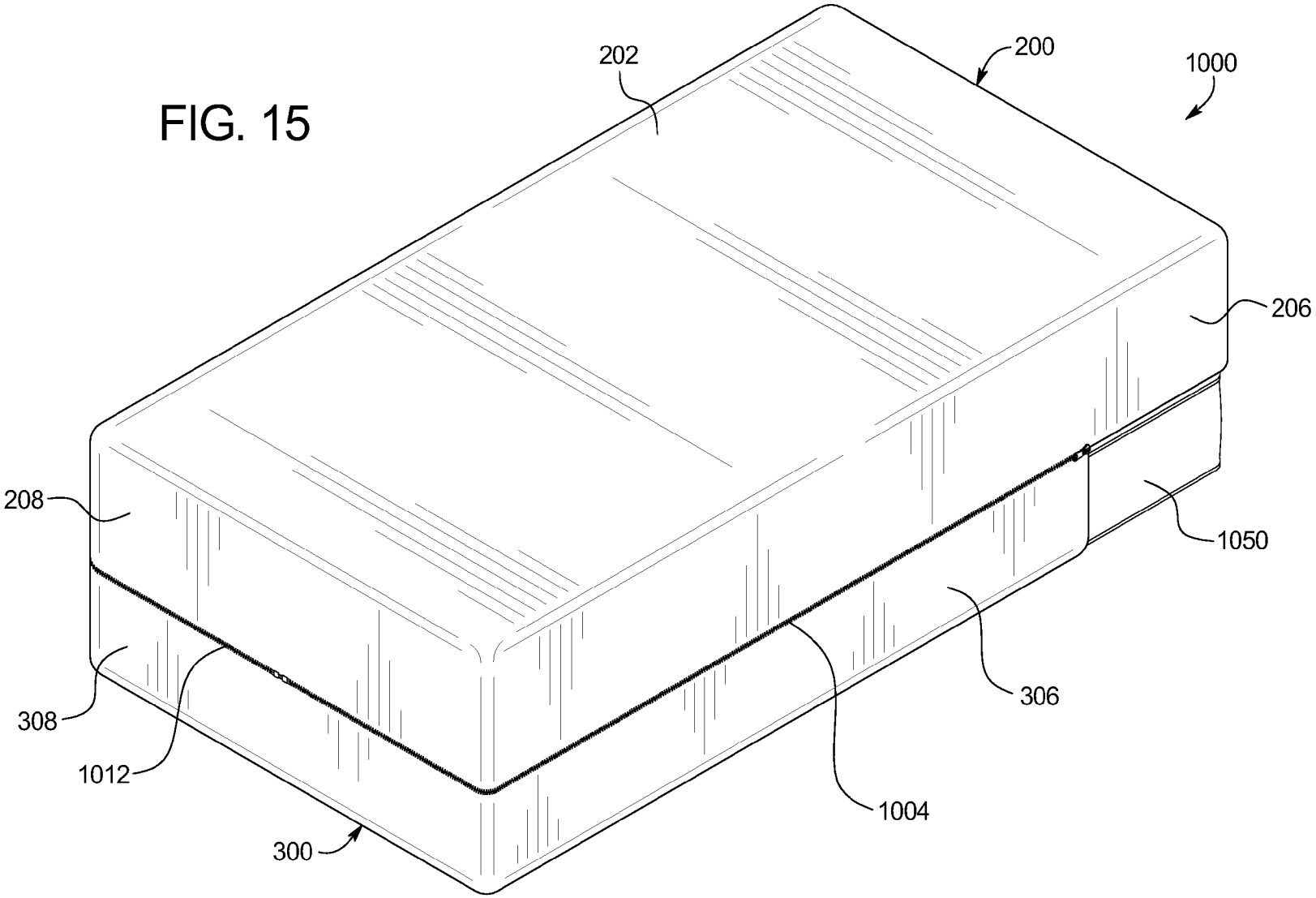
FIG. 15 is a top rear left side perspective view of the bedding apparatus of FIG. 12 in the assembled expanded state and installed around a mattress.
Figure 16:
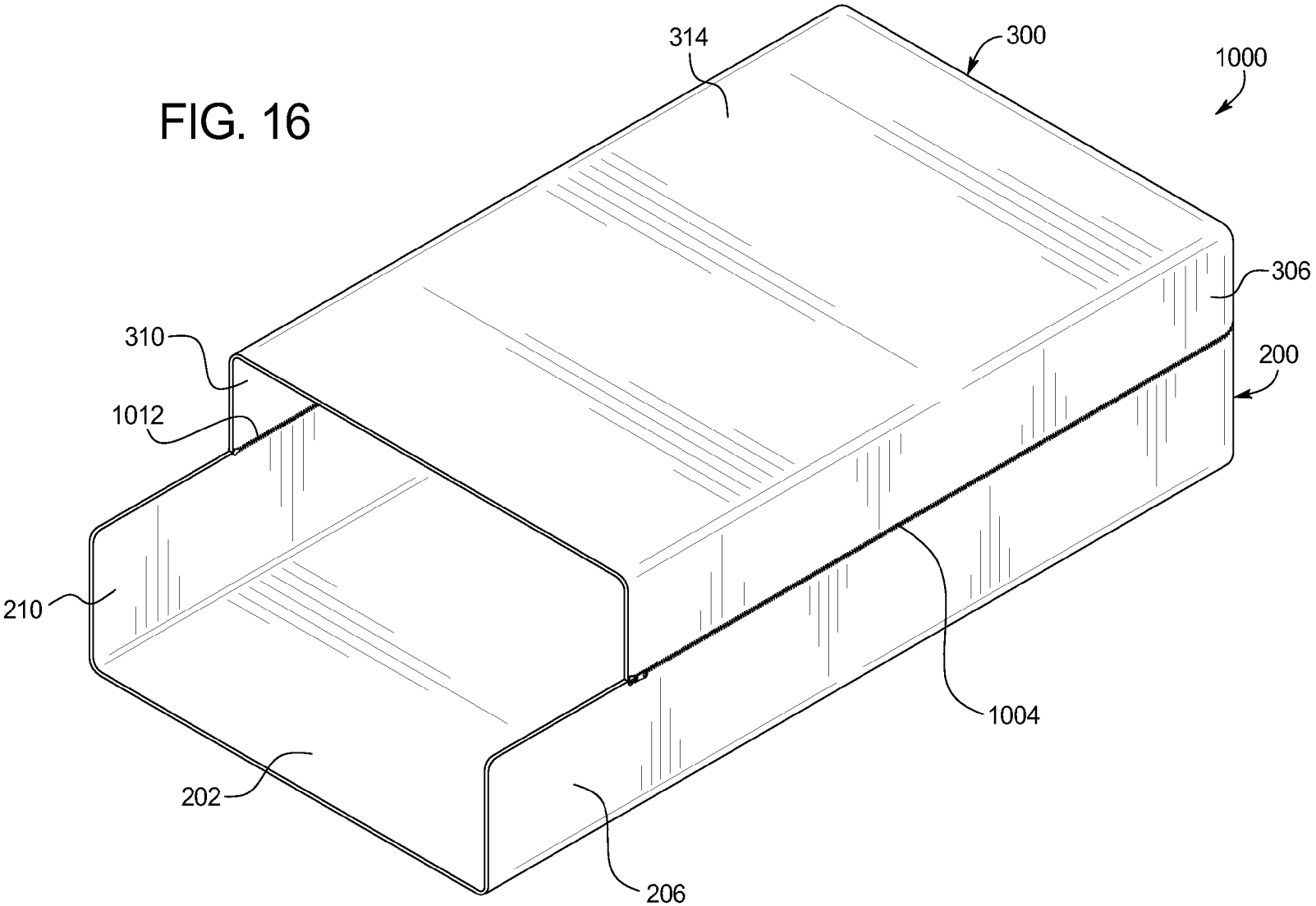
FIG. 16 is a bottom front left side perspective view of the bedding apparatus of FIG. 12 in the assembled expanded state.
Figure 17:
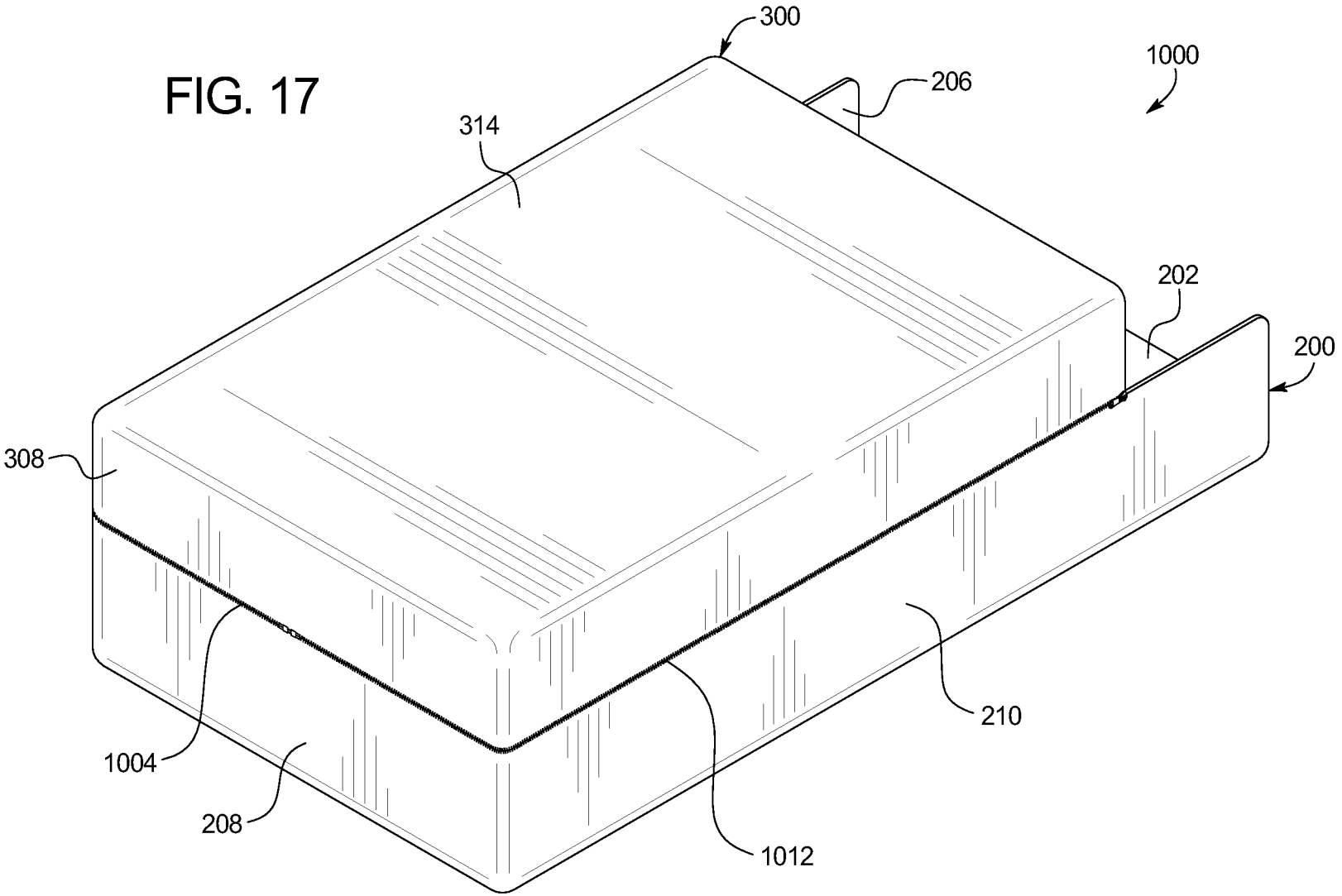
FIG. 17 is a bottom rear right side perspective view of the bedding apparatus of FIG. 12 in the assembled expanded state.
Figure 18:
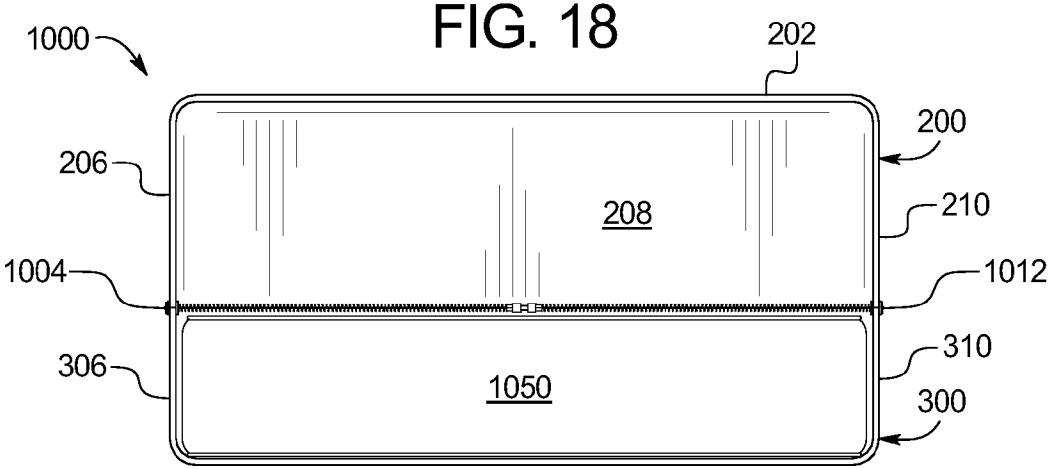
FIG. 18 is a front elevational view of the bedding apparatus of FIG. 12 in the assembled expanded state and installed around a mattress.
Figure 19:
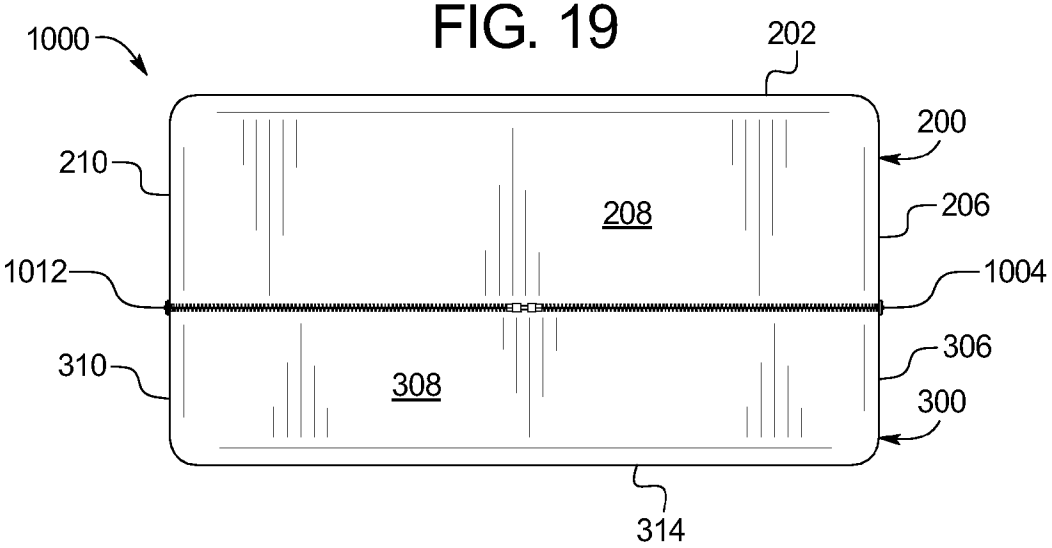
FIG. 19 is a rear elevational view of the bedding apparatus of FIG. 12 in the assembled expanded state.
Figure 20:
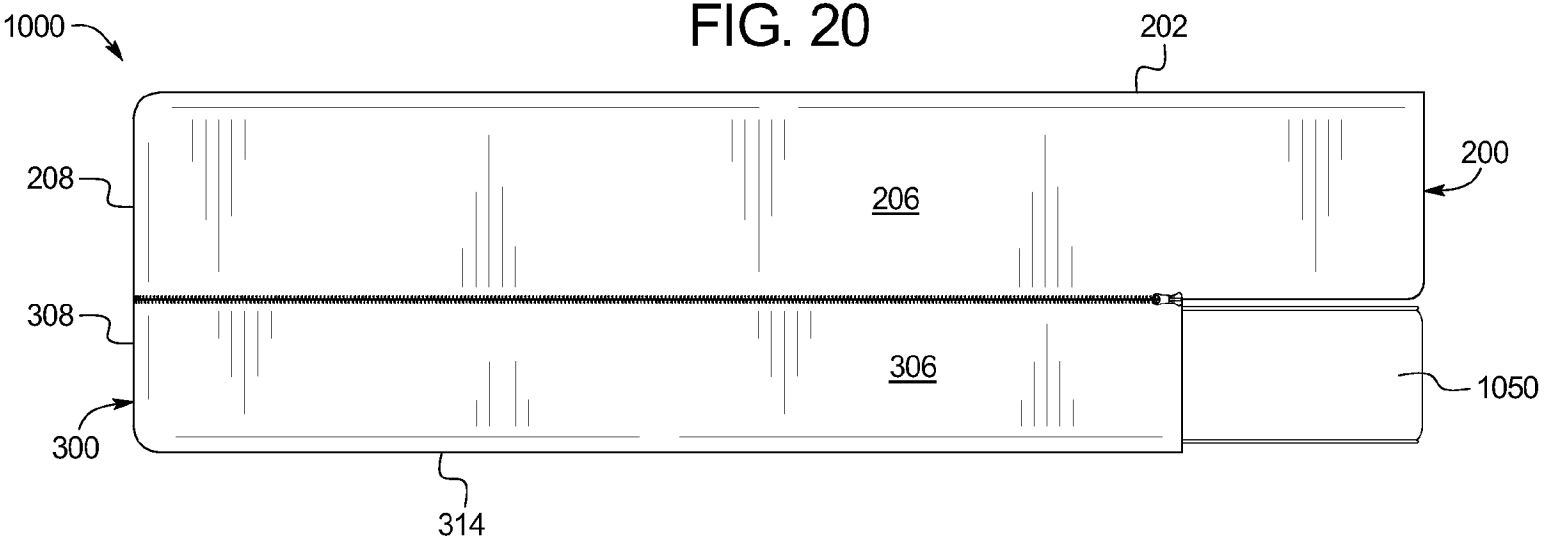
FIG. 20 is a left side elevational view of the bedding apparatus of FIG. 12 in the assembled expanded state and installed around a mattress.
Figure 21:
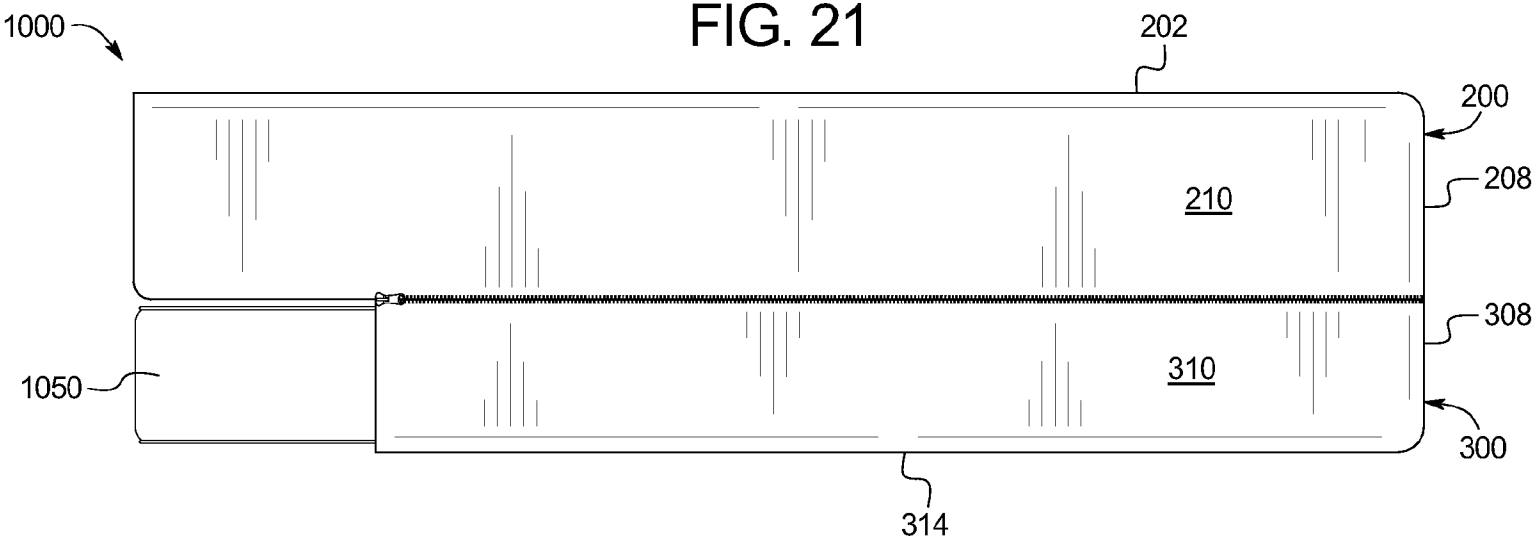
FIG. 21 is a right side elevational view of the bedding apparatus of FIG. 12 in the assembled expanded state and installed around a mattress.
Figure 22:
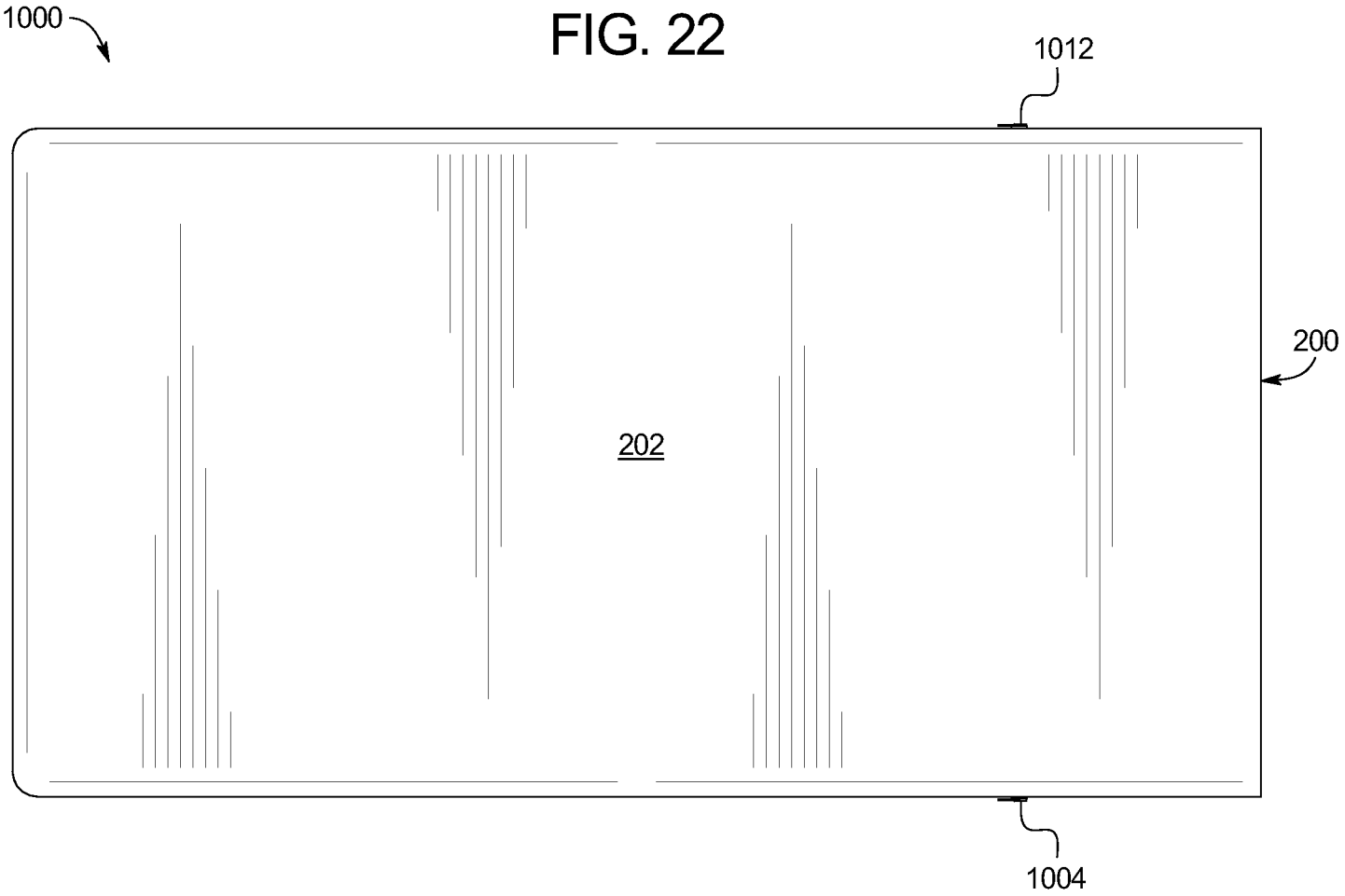
FIG. 22 is a top plan view of the bedding apparatus of FIG. 12 in the assembled expanded state.
Figure 23:
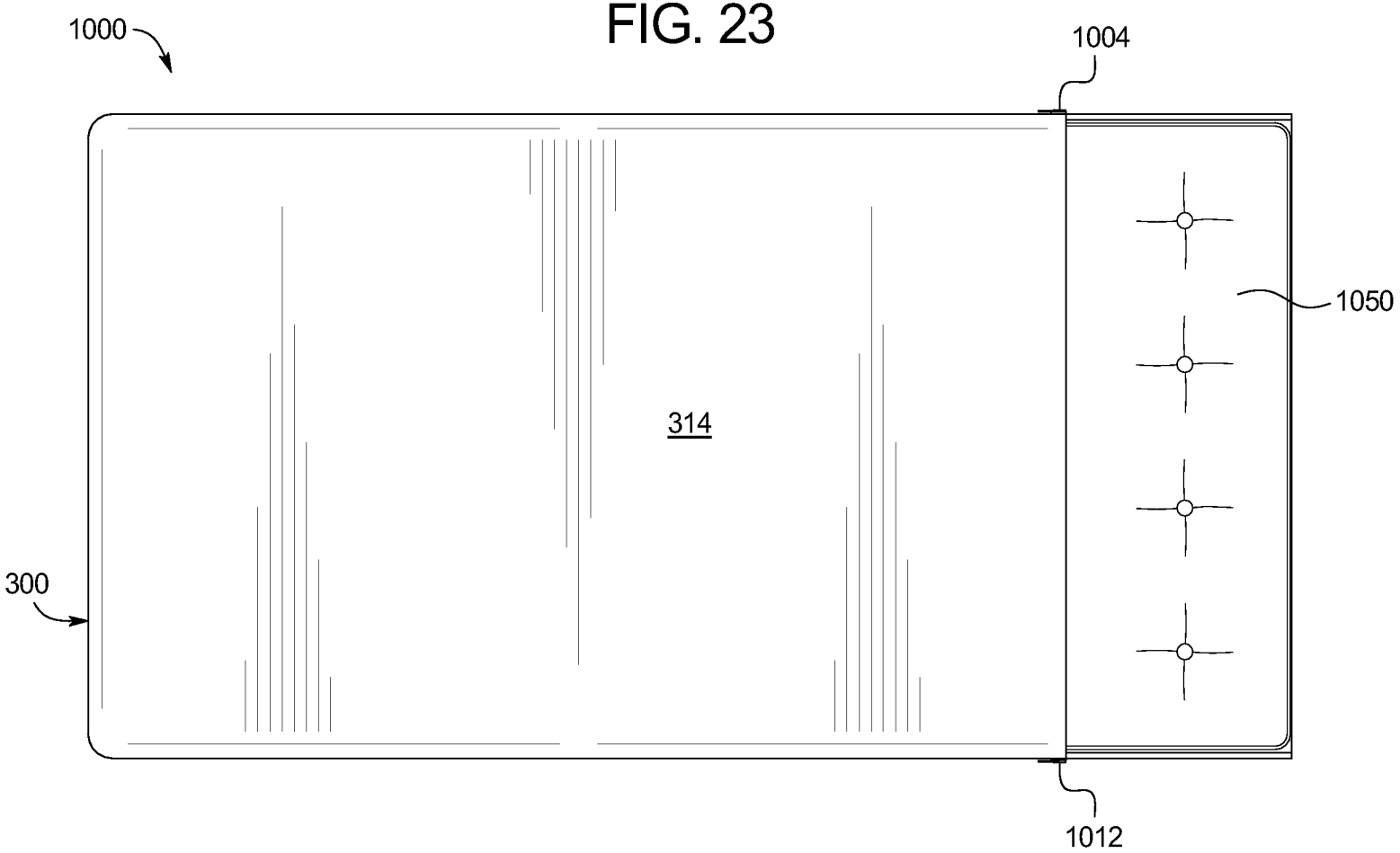
FIG. 23 is a bottom plan view of the bedding apparatus of FIG. 12 in the assembled expanded state and installed around a mattress.
Figure 24:
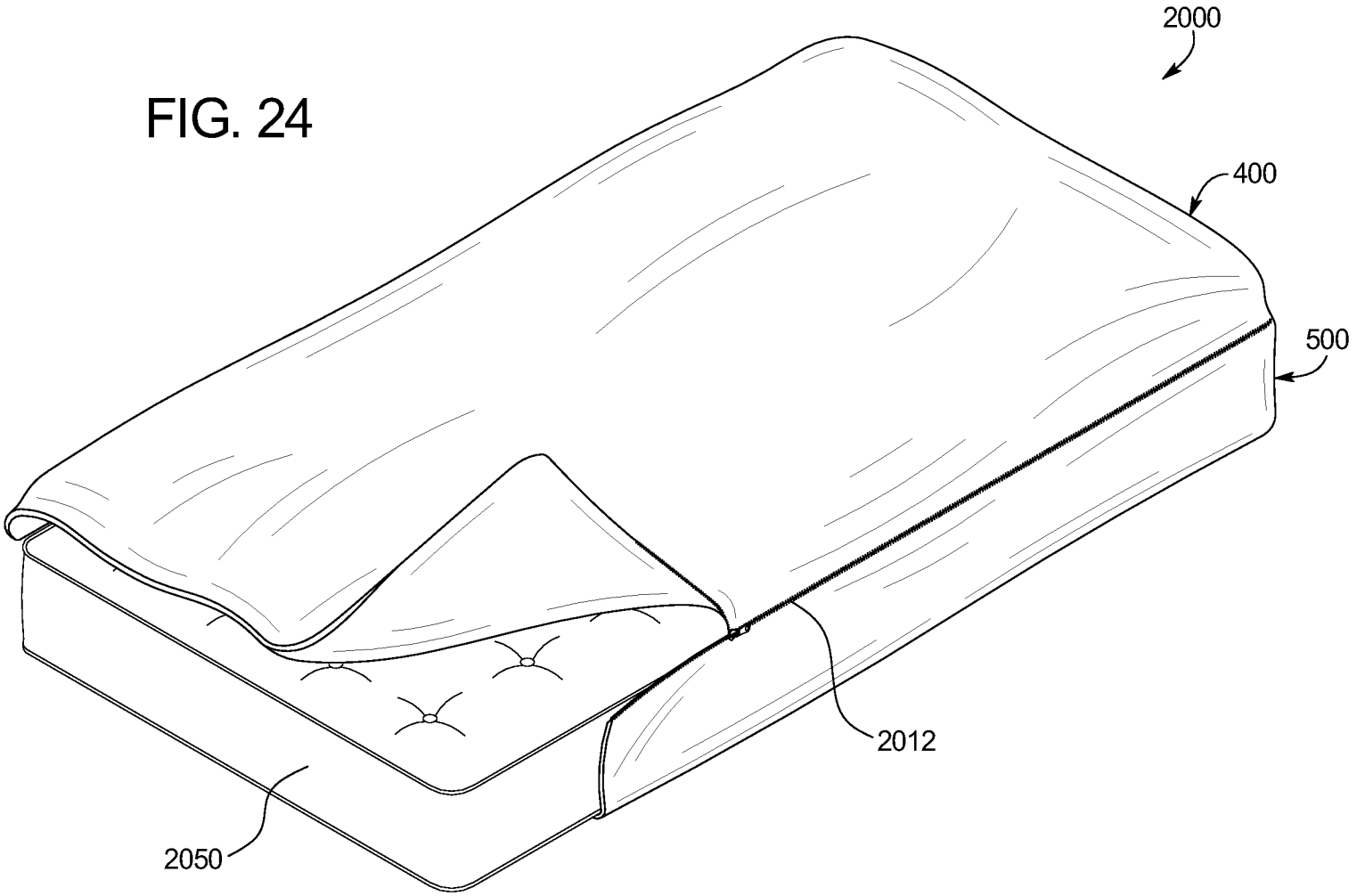
FIG. 24 is a top front right side perspective view of another example embodiment of the bedding apparatus of the present disclosure in a partially-assembled resting state and installed around a mattress.

FIGS. 12 to 23 show one such embodiment of the bedding apparatus, which is generally indicated by numeral 1000. FIG. 12 shows the bedding apparatus 1000 in a resting state. FIGS. 13 to 23 show the bedding apparatus 1000 in an expanded state for illustrative purposes. In this embodiment, the bedding apparatus 1000 generally includes a first or upper portion 200 and a second or lower portion 300 that, as best shown in FIGS. 13 and 14, are completely separated from one another and that are joinable to one another by two attachment mechanisms, as described below.

The upper portion 200 includes: (a) a generally rectangular top panel 202 having a length L1 and a width W1; (b) a generally rectangular left side panel 206 having the length L1 and a height H1; (c) a spaced apart, generally rectangular opposing right side panel 210 having the length L1 and the height H1; and (d) a generally rectangular back panel 208 having the height H1 and the width W1. In this embodiment: (a) a right edge of the top panel 202 of the upper portion 200 is joined or connected to a top edge of the right side panel 210 of the upper portion 200, (b) a back edge of the top panel 202 of the upper portion 200 is joined or connected to a top edge of the back panel 208 of the upper portion 200, (c) a left edge of the top panel 202 of the upper portion 200 is joined or connected to a top edge of the left side panel 206 of the upper portion; (d) a right edge of the back panel 208 of the upper portion 200 is joined or connected to a back edge of the right side panel 210 of the upper portion 200; and (e) a left edge of the back panel 208 of the upper portion 200 is joined or connected to a back edge of the left side panel 206 of the upper portion 200.

The lower portion 300 includes: (a) a generally rectangular bottom panel 314 having a length L2, which is less than the length L1, and the width W1; (b) a generally rectangular left side panel 306 having the length L2 and a height H2, which is less than the height H1 in this embodiment (although the height H2 may be greater than or equal to the height H1 in other embodiments); (c) a spaced apart, generally rectangular opposing right side panel 310 having the length L2 and the height H2; and (d) a generally rectangular back panel 308 having the height H2 and the width W1. In this embodiment: (a) a right edge of the bottom panel 314 of the lower portion 300 is joined or connected to a bottom edge of the right side panel 310 of the lower portion 300, (b) a back edge of the bottom panel 314 of the lower portion 300 is joined or connected to a bottom edge of the back panel 308 of the lower portion 300, (c) a left edge of the bottom panel 314 of the lower portion 300 is joined or connected to a bottom edge of the left side panel 306 of the lower portion 300; (d) a right edge of the back panel 308 of the lower portion 300 is joined or connected to a back edge of the right side panel 310 of the lower portion 300; and (e) a left edge of the back panel 308 of the lower portion 300 is joined or connected to a back edge of the left side panel 306 of the lower portion 300.

The bedding apparatus 1000 includes a left attachment mechanism 1004, which is a zipper in this embodiment, configured to join (and unjoin): (a) the left side panel 206 of the upper portion 200 with the left side panel 306 of the lower portion 300; and (b) a first part of the back panel 208 of the upper portion 200 with a first part of the back panel 308 of the lower portion 300. The bedding apparatus also includes a right attachment mechanism 1012, which is a zipper in this embodiment, configured to join (an unjoin): (a) the right side panel 210 of the upper portion 200 with the right side panel 310 of the lower portion 300; and (b) a second part of the back panel 208 of the upper portion 200 with a second part of with back panel 308 of the lower portion 300.

In this embodiment, inner surfaces of the top panel 202 of the upper portion 200, the bottom panel 314 of the lower portion 300, the right side panels 210 and 310 of the upper and lower portions 200 and 300, the left side panels 206 and 306 of the upper and lower portions 200 and 300, and the back panels 208 and 308 of the upper and lower portions 200 and 300 define a mattress receiving space. The bedding apparatus 1000 is installed around a mattress 1050 as generally described above.

Figure 25:
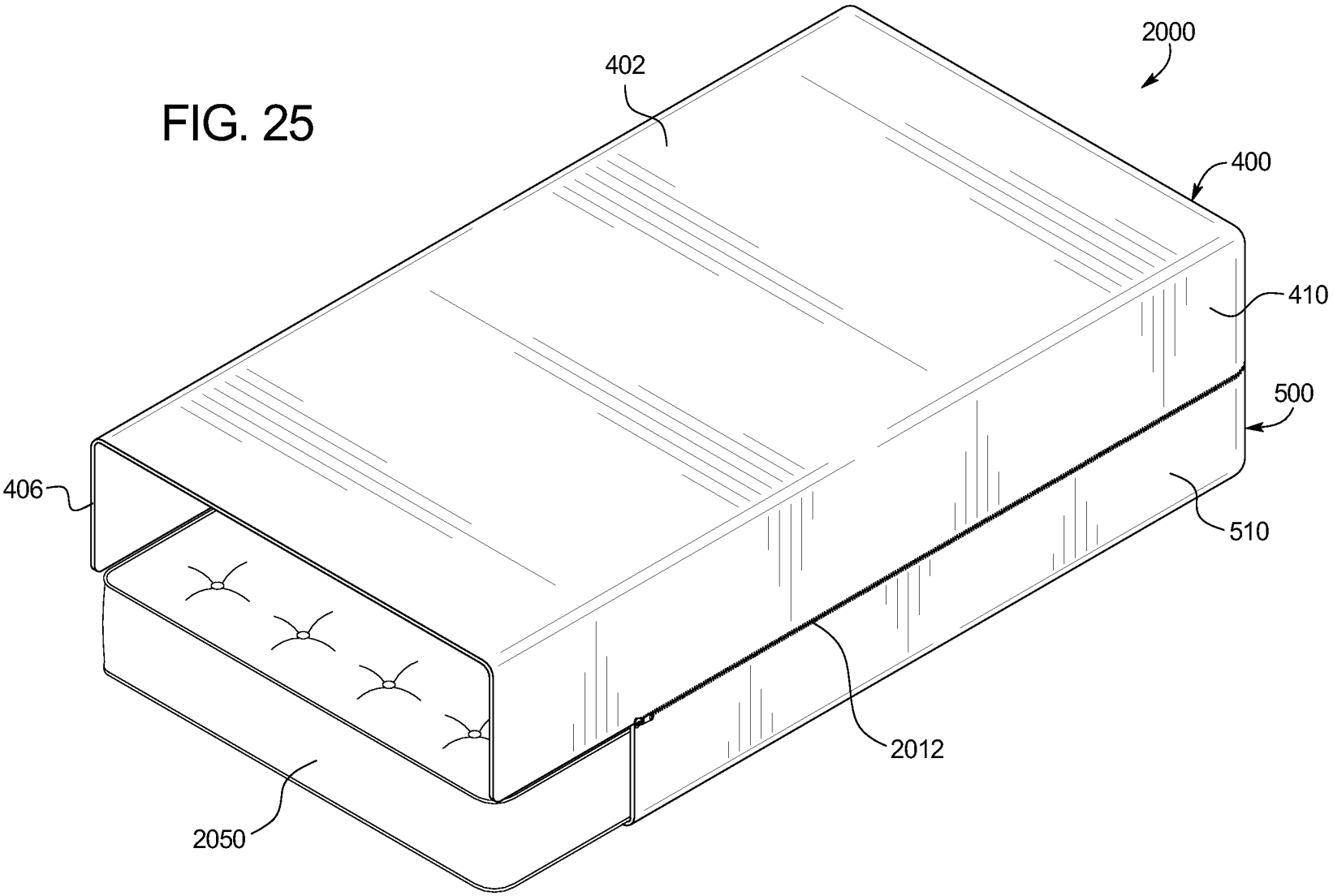
FIG. 25 is a top front right side perspective view of the bedding apparatus of FIG. 24 in an assembled expanded state and installed around a mattress.
Figure 26:
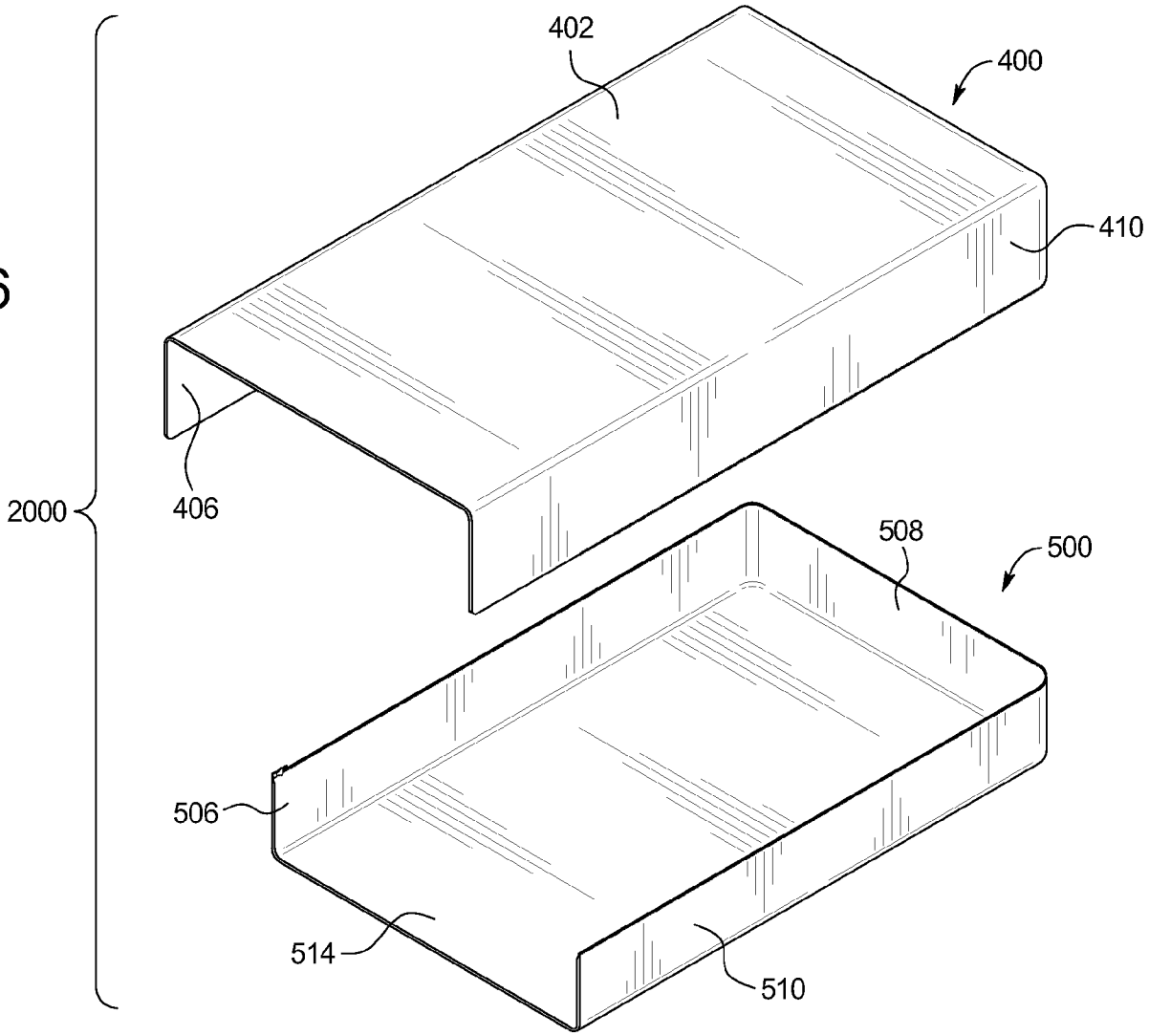
FIG. 26 is a top front right side perspective view of the bedding apparatus of FIG. 24 in an exploded expanded state.
Figure 27:
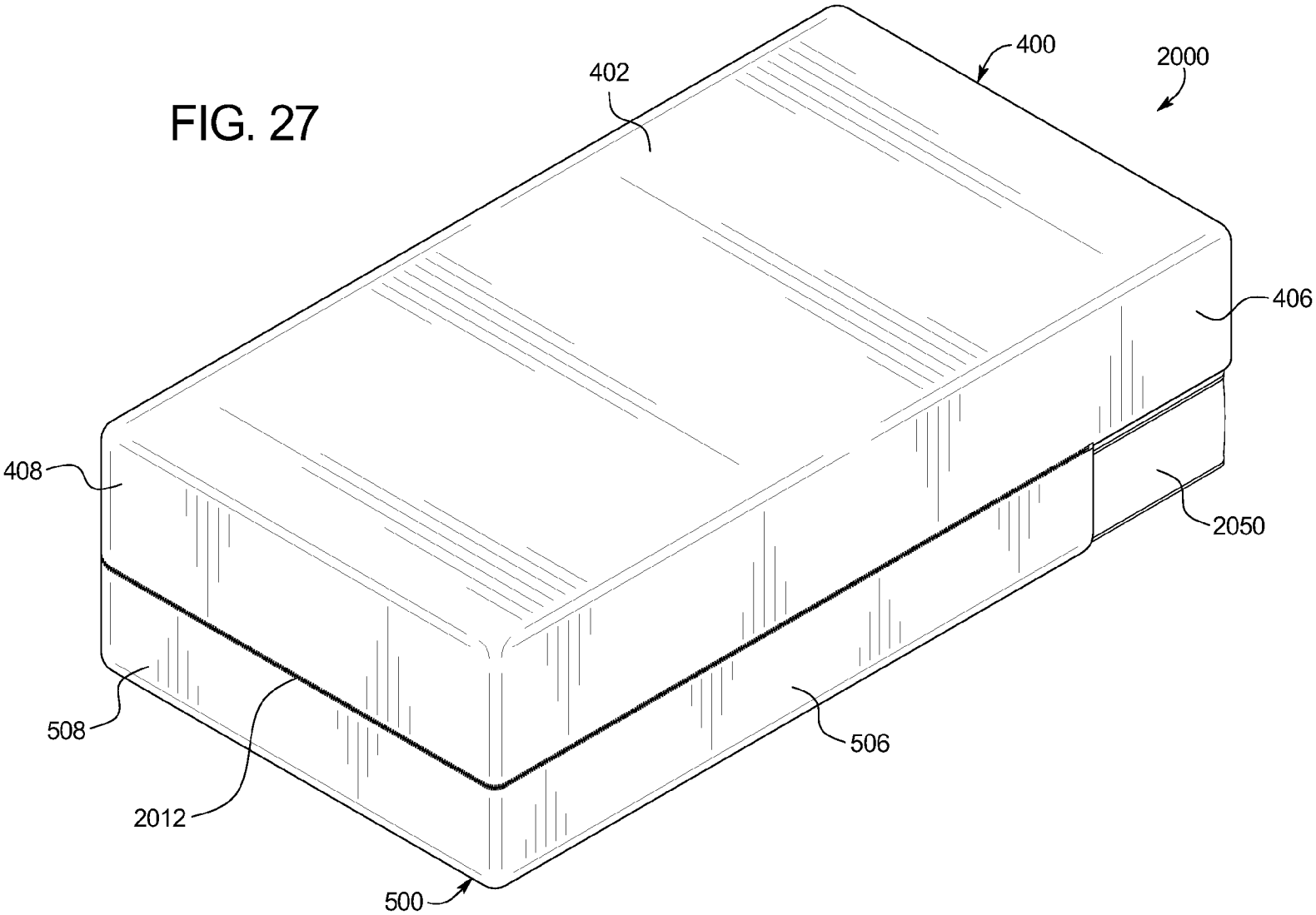
FIG. 27 is a top rear left side perspective view of the bedding apparatus of FIG. 24 in the assembled expanded state and installed around a mattress.
Figure 28:
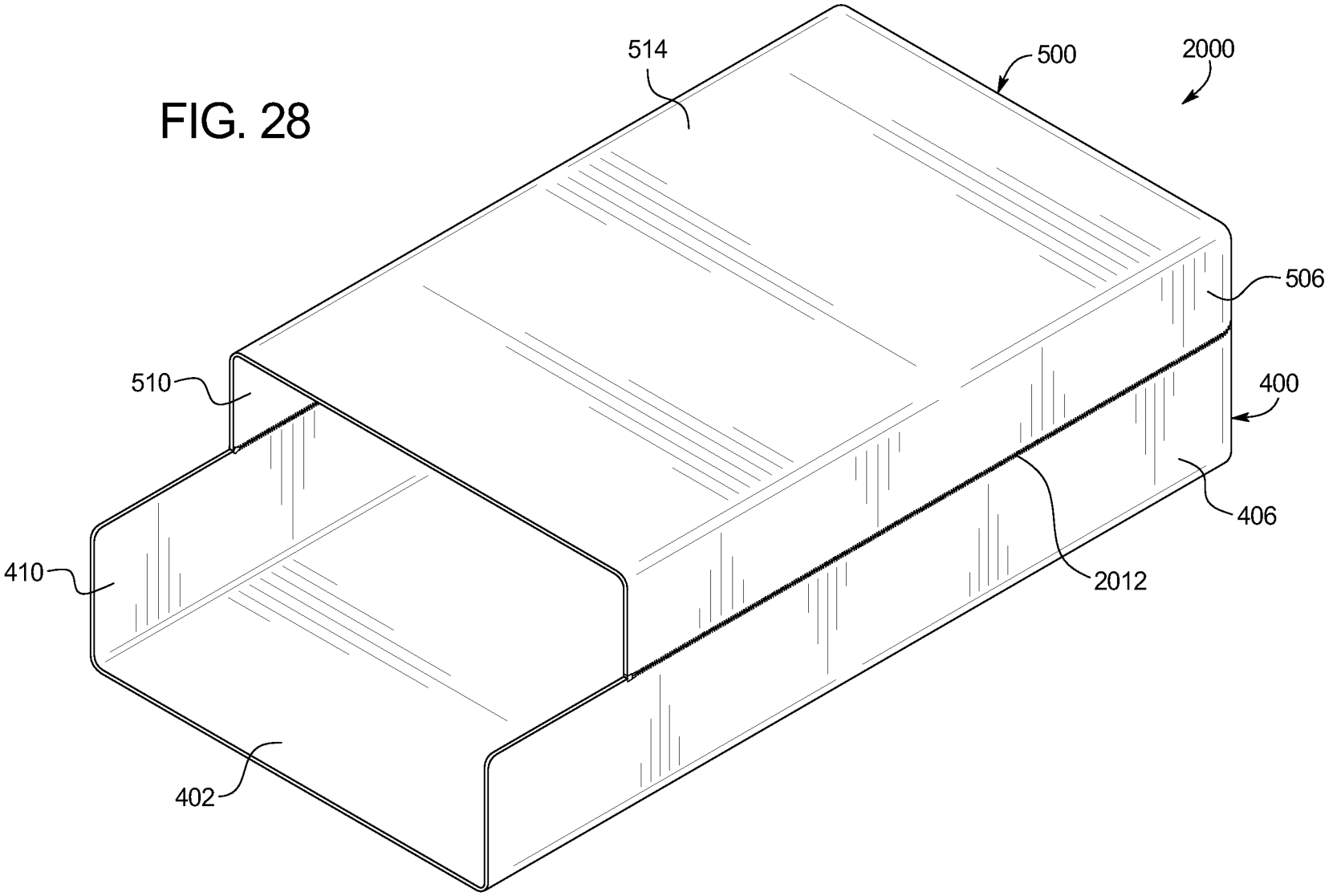
FIG. 28 is a bottom front left side perspective view of the bedding apparatus of FIG. 24 in the assembled expanded state.
Figure 29:
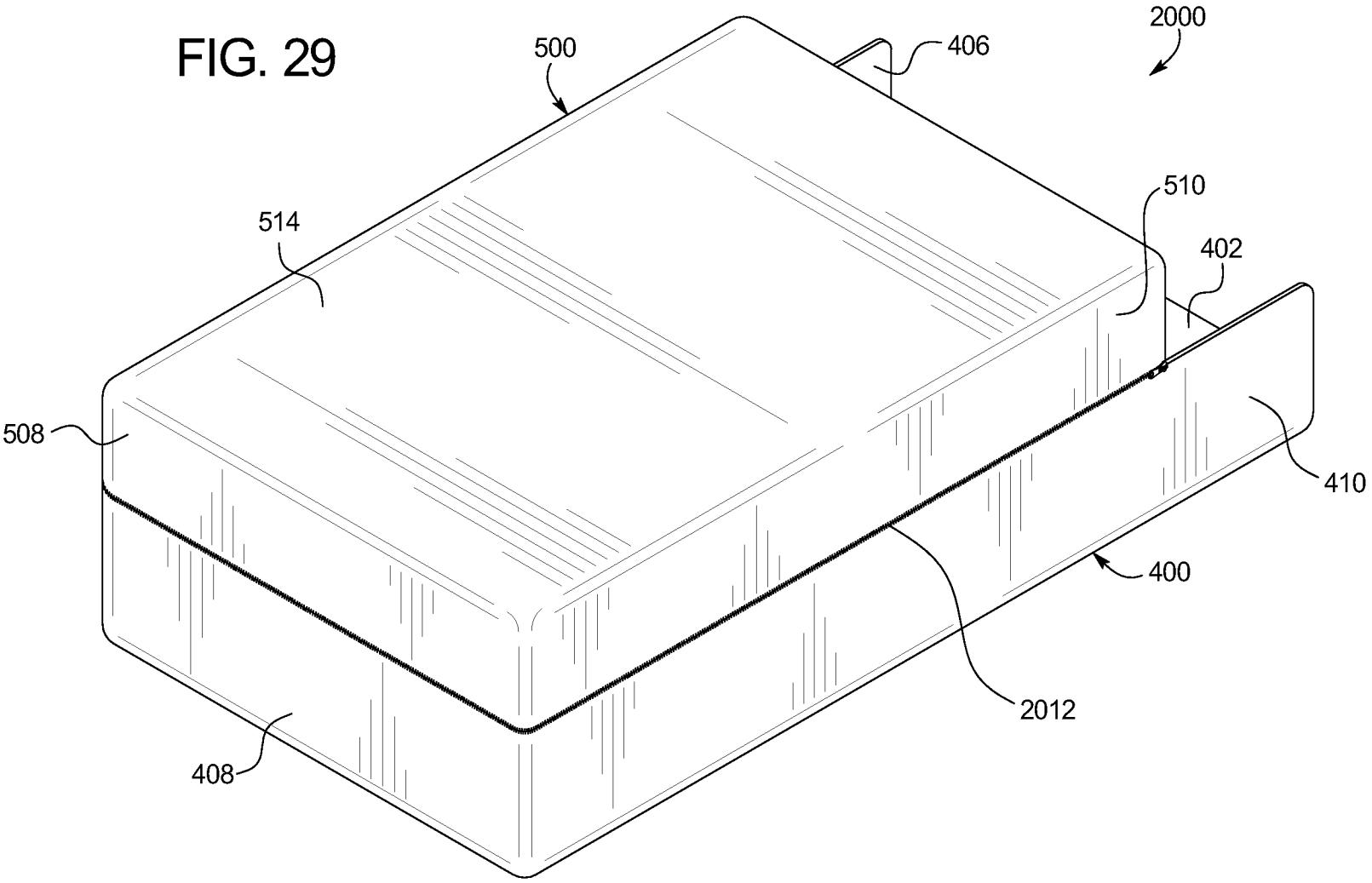
FIG. 29 is a bottom rear right side perspective view of the bedding apparatus of FIG. 24 in the assembled expanded state.
Figure 30:
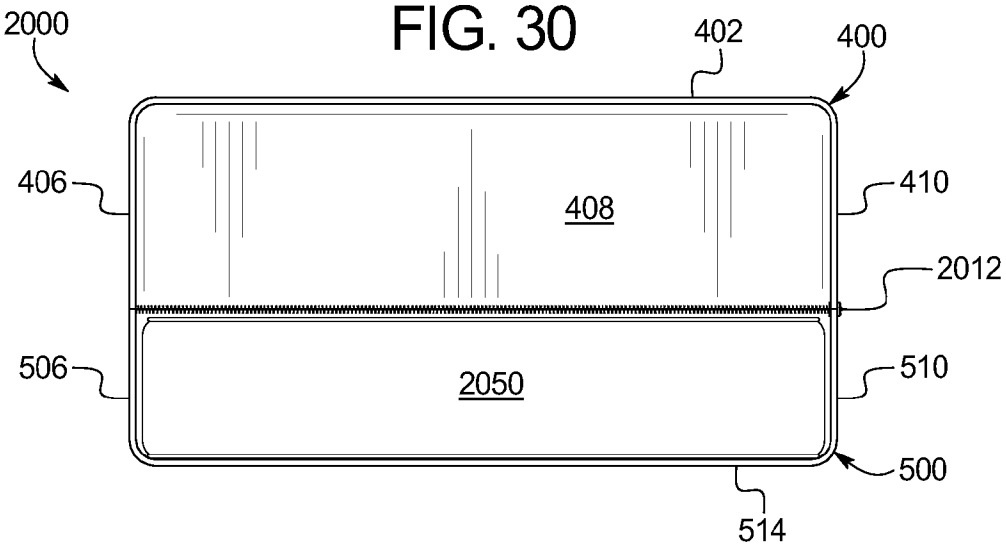
FIG. 30 is a front elevational view of the bedding apparatus of FIG. 24 in the assembled expanded state and installed around a mattress.
Figure 31:
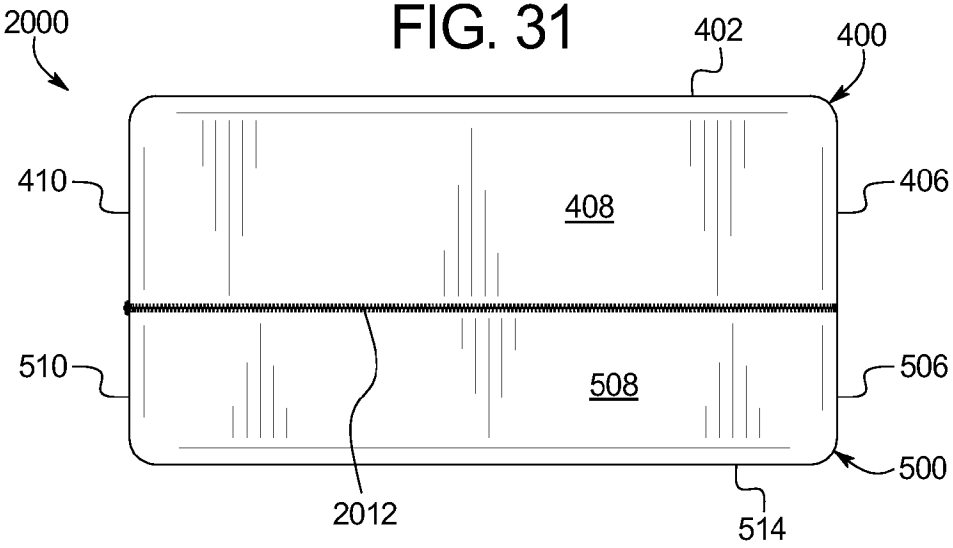
FIG. 31 is a rear elevational view of the bedding apparatus of FIG. 24 in the assembled expanded state.
Figure 32:
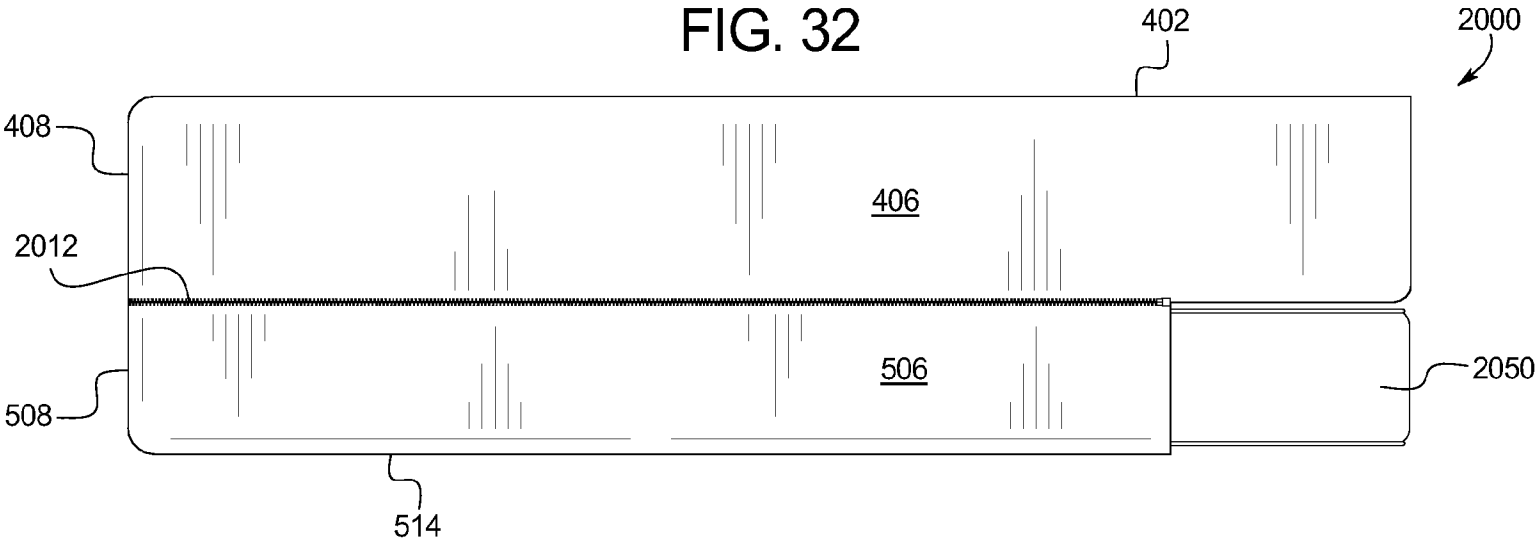
FIG. 32 is a left side elevational view of the bedding apparatus of FIG. 24 in the assembled expanded state and installed around a mattress.
Figure 33:
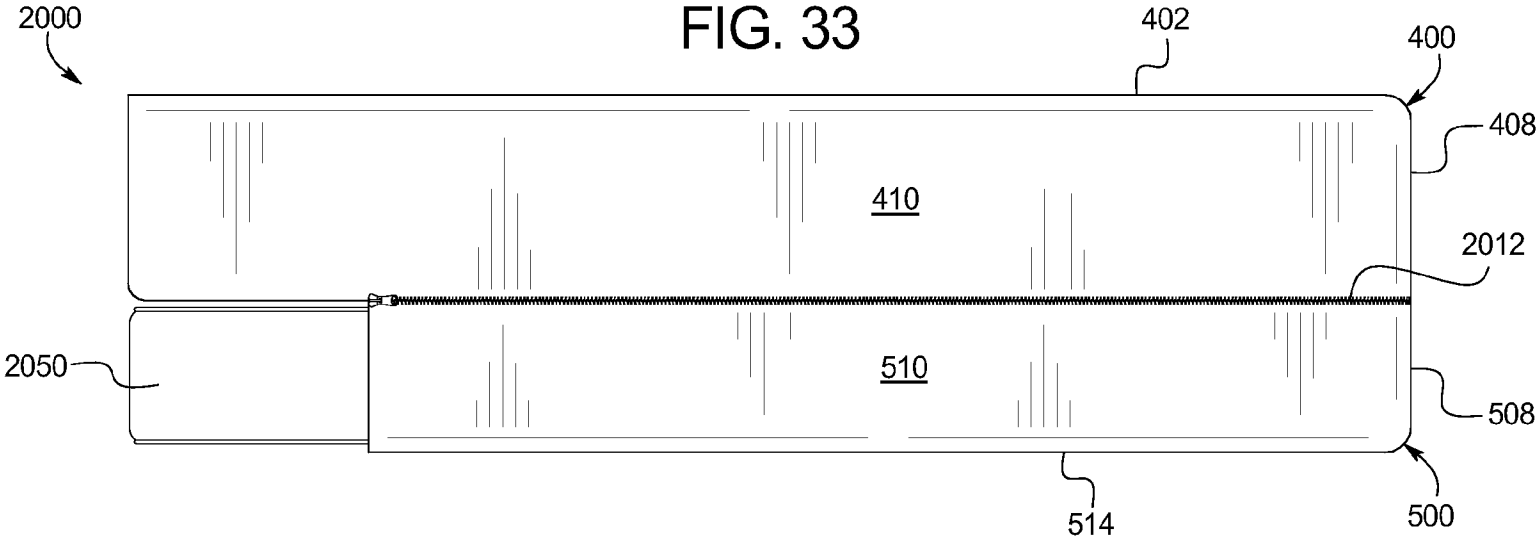
FIG. 33 is a right side elevational view of the bedding apparatus of FIG. 24 in the assembled expanded state and installed around a mattress.
Figure 34:
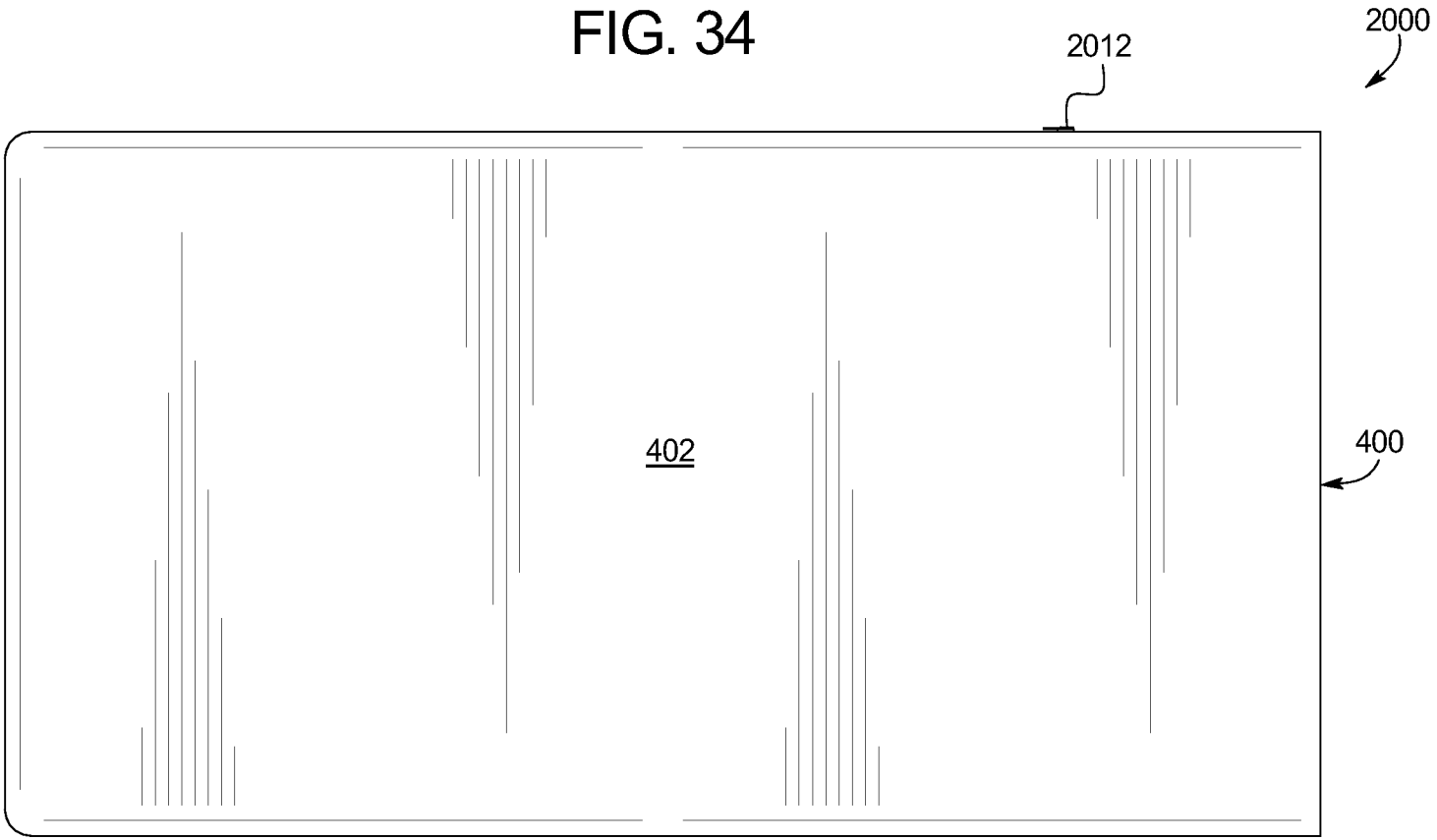
FIG. 34 is a top plan view of the bedding apparatus of FIG. 24 in the assembled expanded state.
Figure 35:
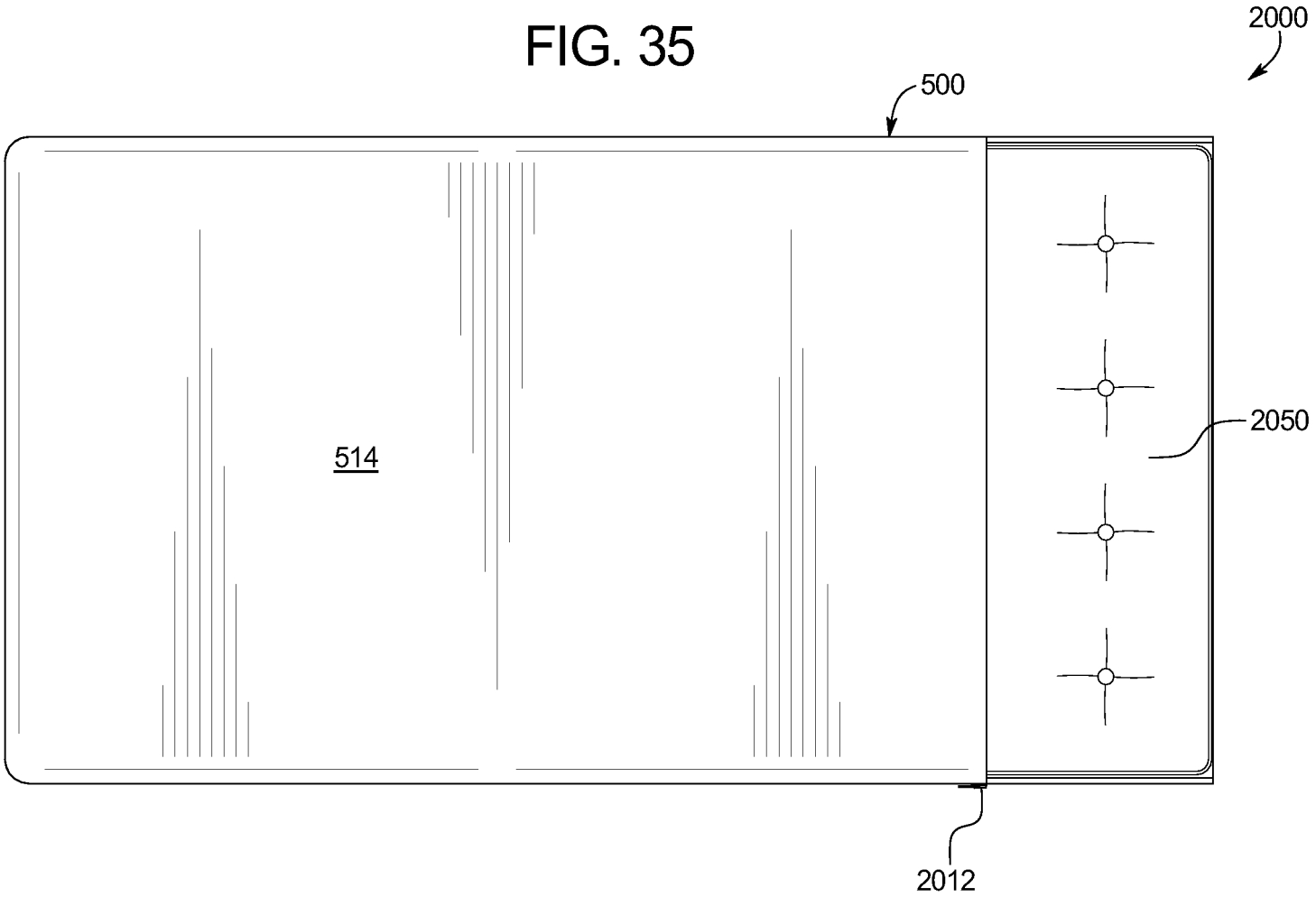
FIG. 35 is a bottom plan view of the bedding apparatus of FIG. 24 in the assembled expanded state and installed around a mattress.

FIGS. 24 to 35 show another such embodiment of the bedding apparatus, which is generally indicated by numeral 2000. FIG. 14 shows the bedding apparatus 2000 in a resting state. FIGS. 25 to 35 show the bedding apparatus 2000 in an expanded state for illustrative purposes. In this embodiment, the bedding apparatus 2000 generally includes a first or upper portion 400 and a second or lower portion 500 that, as best shown in FIGS. 25 and 26, are completely separated from one another and that are joinable to one another by a single attachment mechanism, as described below.

The upper portion 400 includes: (a) a generally rectangular top panel 402 having a length L1 and a width W1; (b) a generally rectangular left side panel 406 having the length L1 and a height H1; (c) a spaced apart, generally rectangular opposing right side panel 410 having the length L1 and the height H1; and (d) a generally rectangular back panel 408 having the height H1 and the width W1. In this embodiment: (a) a right edge of the top panel 402 of the upper portion 400 is joined or connected to a top edge of the right side panel 410 of the upper portion 400, (b) a back edge of the top panel 402 of the upper portion 400 is joined or connected to a top edge of the back panel 408 of the upper portion 400, (c) a left edge of the top panel 402 of the upper portion 400 is joined or connected to a top edge of the left side panel 406 of the upper portion; (d) a right edge of the back panel 408 of the upper portion 400 is joined or connected to a back edge of the right side panel 410 of the upper portion 400; and (e) a left edge of the back panel 408 of the upper portion 400 is joined or connected to a back edge of the left side panel 406 of the upper portion 400.

The lower portion 500 includes: (a) a generally rectangular bottom panel 514 having a length L2, which is less than the length L1, and the width W1; (b) a generally rectangular left side panel 506 having the length L2 and a height H2, which is less than the height H1 in this embodiment (although the height H2 may be greater than or equal to the height H1 in other embodiments); (c) a spaced apart, generally rectangular opposing right side panel 510 having the length L2 and the height H2; and (d) a generally rectangular back panel 508 having the height H2 and the width W1. In this embodiment: (a) a right edge of the bottom panel 514 of the lower portion 500 is joined or connected to a bottom edge of the right side panel 510 of the lower portion 500, (b) a back edge of the bottom panel 514 of the lower portion 500 is joined or connected to a bottom edge of the back panel 508 of the lower portion 500, (c) a left edge of the bottom panel 514 of the lower portion 500 is joined or connected to a bottom edge of the left side panel 506 of the lower portion 500; (d) a right edge of the back panel 508 of the lower portion 500 is joined or connected to a back edge of the right side panel 510 of the lower portion 500; and (e) a left edge of the back panel 508 of the lower portion 500 is joined or connected to a back edge of the left side panel 506 of the lower portion 500.

The bedding apparatus 2000 includes a single attachment mechanism 2012, which is a zipper in this embodiment, configured to join (and unjoin): (a) the left side panel 406 of the upper portion 400 with the left side panel 506 of the lower portion 500; (b) the back panel 408 of the upper portion 400 with the back panel 508 of the lower portion 500; and (c) the right side panel 410 of the upper portion 400 with the right side panel 510 of the lower portion 500.

In this embodiment, inner surfaces of the top panel 402 of the upper portion 400, the bottom panel 514 of the lower portion 500, the right side panels 410 and 510 of the upper and lower portions 400 and 500, the left side panels 406 and 506 of the upper and lower portions 400 and 500, and the back panels 408 and 508 of the upper and lower portions 400 and 500 define a mattress receiving space. The bedding apparatus 2000 is installed around a mattress 2050 as generally described above.

The completely separable nature of the upper and lower portions of the bedding apparatuses of these embodiments provides a variety of advantages. For instance, since the user sleeps under the upper portion of the bedding apparatus but has no substantial contact with the lower portion of the bedding apparatus, the user may desire to launder the upper portion of the bedding apparatus without laundering the lower portion of the bedding apparatus. Since the upper and lower portions are completely separable in these embodiments, to do so the user simply detaches the upper portion from the lower portion and launders the upper portion without moving the lower portion. This saves time and resources that would otherwise be wasted to unnecessarily launder the lower portion.

Additionally, since the user sleeps under the upper portion of the bedding apparatus but has no substantial contact with the lower portion of the bedding apparatus, the user may desire to change the type of material of the upper portion periodically, such as when the seasons change, without changing the type of material of the lower portion. For example, the user may desire an upper portion made of lightweight cotton during the summer (when temperatures are high) and an upper portion made of fleece during the winter (when temperatures are low). Since the upper and lower portions are completely separable in these embodiments, the user simply detaches the undesired upper portion from the lower portion, chooses a desired upper portion, and joins the desired upper portion to the lower portion. This eliminates the need for users to purchase different bedding apparatuses made of entirely different materials.

It should thus be appreciated that, in certain such embodiments, the lower portion is usable with a variety of different interchangeable upper portions, such as upper portions made of different materials or having different designs.

In certain such embodiments, the components of the upper portion are integrally formed (e.g., formed from a single piece of fabric) and the components of the lower portion are integrally formed (e.g., formed from a single piece of fabric).

It should be appreciated that the attachment mechanism may be any suitable attachment mechanism instead of or in addition to a zipper such as, but not limited to, a hook and loop fastener (such as a Velcro® fastener), a plurality of buttons, a plurality of snaps, a tied elastic string or band, clips, or any other suitable reclosable fastener.

In another embodiment, the lengths of the top panel, the bottom panel, the upper and lower portions of the left side panel, and the upper and lower portions of the right side panel of the bedding apparatus are the same, though it should be appreciated that the different components of the bedding apparatus may have any suitable size.

The bedding apparatus may be made of any suitable material such as, but not limited to: natural fabric such as cotton, wool, silk, cashmere, or linen; synthetic fabric such as rayon, polyester (fleece or cotton blend), nylon, or acrylic; lightweight fabric such as linen, silk, nylon, or cotton; and/or heavyweight fabric such as polar fleece, cozy fleece, or wool. The material of the bedding apparatus may include a single layer or multiple layers. In one example embodiment, the bedding apparatus is made of a multi-layer fabric including an outer layer of anti-pill fleece and an inner layer of fleece.

In one embodiment, the bedding apparatus is formed from a single piece of material. In another embodiment, the bedding apparatus is formed from a plurality of pieces or material (such as a plurality of pieces of material joined or connected (such as sewed) together to form the bedding apparatus).

In one embodiment, the top panel of the bedding apparatus is made of an expandable or stretchable material. This provides the user with extra room to maneuver when laying atop the mattress beneath the top panel of the bedding apparatus. In another embodiment, the side panels of the bedding apparatus are made of the expandable or stretchable material. In another embodiment, the back panel of the bedding apparatus is made of the expandable or stretchable material. It should be appreciated that any suitable combination of the top panel, the back panel, and the side panels are made of the expandable or stretchable material.

In other embodiments, the height of the upper portions of the side panels is larger than the height of the lower portions of the side panels. There embodiments provide additional room for the user to maneuver when laying atop the mattress and under the top panel of the bedding apparatus. It should be appreciated that the various components of the bedding apparatus may be sized in any suitable manner.

In one embodiment, two bedding apparatuses are configured to be joined or connected to one another, such as via the attachment mechanisms, to form a larger, combined double bedding apparatus. For example, the right attachment mechanism of one bedding apparatus is connected to the left attachment mechanism of another bedding apparatus.

In other embodiments, the bedding apparatus includes one or more interior or exterior pockets. In another embodiment, the bedding apparatus includes one or more integrated interior or exterior cable channels configured to route cables, such as cell phone charger or tablet computer charger cables, from one end (such as the rear end) of the bedding apparatus to another (such as the front end).

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A bedding apparatus comprising:

(a) an upper portion including:

(i) a top panel having a first length and a first width;

(ii) an upper portion left side panel connected to the top panel and having the first length and a first height;

(iii) an opposing upper portion right side panel connected to the top panel and having the first length and the first height; and (iv) an upper portion back panel connected to the top panel, the upper portion left side panel, and the upper portion right side panel; extending between the upper portion left side panel and the upper portion right side panel; and having the first height and the first width;

(b) a lower portion including:

(i) a bottom panel having a second length and the first width;

(ii) a lower portion left side panel connected to the bottom panel and having the second length and a second height;

(iii) an opposing lower portion right side panel connected to the bottom panel and having the second length and the second height; and (iv) an upper portion back panel connected to the lower panel, the lower portion left side panel, and the lower portion right side panel; extending between the lower portion left side panel and the lower portion right side panel; and having the second height and the first width;

(c) a first attachment mechanism configured to join: (i) the upper portion left side panel with the lower portion left side panel, and (ii) a first part of the upper portion back panel with a first part of the lower portion back panel; and (d) a second attachment mechanism configured to join: (i) the upper portion right side panel with the lower portion right side panel, and (ii) a second part of the upper portion back panel with a second part of the lower portion back panel.

2. The bedding apparatus of claim 1, wherein the first and second attachment mechanisms are zippers.

3. The bedding apparatus of claim 1, wherein an inner surface of the top panel, inner surfaces of the upper portion and lower portion back panels, inner surfaces of the upper portion and lower portion left side panels, inner surfaces of the upper portion and lower portion right side panels, and an inner surface of the bottom panel define a mattress receiving space configured to receive a mattress.

4. The bedding apparatus of claim 3, wherein at least one-half of the mattress receiving space is not occupied by the mattress after the bedding apparatus receives the mattress.

5. The bedding apparatus of claim 1, wherein the first height and the second height are the same.

6. The bedding apparatus of claim 1, wherein the first height and the second height are different.

7. The bedding apparatus of claim 1, wherein the first length and the second length are different.

8. The bedding apparatus of claim 7, wherein the first length is greater than the second length.

9. The bedding apparatus of claim 1, wherein the top panel, the upper portion left side panel, the upper portion right side panel, and the upper portion back panel are integrally formed.

10. The bedding apparatus of claim 1, wherein the top panel, the lower portion left side panel, the lower portion right side panel, and the lower portion back panel are integrally formed.

11. A bedding apparatus comprising:

(a) an upper portion including:

(i) a top panel having a first length and a first width;

(ii) an upper portion left side panel connected to the top panel and having the first length and a first height;

(iii) an opposing upper portion right side panel connected to the top panel and having the first length and the first height; and (iv) an upper portion back panel connected to the top panel, the upper portion left side panel, and the upper portion right side panel; extending between the upper portion left side panel and the upper portion right side panel; and having the first height and the first width;

(b) a lower portion including:

(i) a bottom panel having a second length and the first width;

(ii) a lower portion left side panel connected to the bottom panel and having the second length and a second height;

(iii) an opposing lower portion right side panel connected to the bottom panel and having the second length and the second height; and (iv) an upper portion back panel connected to the lower panel, the lower portion left side panel, and the lower portion right side panel; extending between the lower portion left side panel and the lower portion right side panel; and having the second height and the first width;

(c) an attachment mechanism configured to join: (i) the upper portion left side panel with the lower portion left side panel, (ii) the upper portion back panel with the lower portion back panel, and (iii) the upper portion right side panel with the lower portion right side panel.

12. The bedding apparatus of claim 11, wherein the attachment mechanism is a zipper.

13. The bedding apparatus of claim 11, wherein an inner surface of the top panel, inner surfaces of the upper portion and lower portion back panels, inner surfaces of the upper portion and lower portion left side panels, inner surfaces of the upper portion and lower portion right side panels, and an inner surface of the bottom panel define a mattress receiving space configured to receive a mattress.

14. The bedding apparatus of claim 13, wherein at least one-half of the mattress receiving space is not occupied by the mattress after the bedding apparatus receives the mattress.

15. The bedding apparatus of claim 11, wherein the first height and the second height are the same.

16. The bedding apparatus of claim 11, wherein the first height and the second height are different.

17. The bedding apparatus of claim 11, wherein the first length and the second length are different.

18. The bedding apparatus of claim 17 wherein the first length is greater than the second length.

19. The bedding apparatus of claim 11, wherein: (a) the top panel, the upper portion left side panel, the upper portion right side panel, and the upper portion back panel are integrally formed, and (b) the top panel, the lower portion left side panel, the lower portion right side panel, and the lower portion back panel are integrally formed.

* * * * *